US012098550B2

(12) United States Patent
Damiani et al.

(10) Patent No.: US 12,098,550 B2
(45) Date of Patent: Sep. 24, 2024

(54) PADEYE, CONNECTIONS, AND MOORING SOLUTION FOR CONCRETE ANCHORS

(71) Applicant: RRD Engineering LLC, Arvada, CO (US)

(72) Inventors: Rick Damiani, Arvada, CO (US); Max Franchi, Pescara (IT)

(73) Assignee: The Floating Wind Technology Company, LLC, Arvada, CO (US)

( * ) Notice: Subject to any disclaimer, the term of this patent is extended or adjusted under 35 U.S.C. 154(b) by 123 days.

(21) Appl. No.: 17/494,820

(22) Filed: Oct. 5, 2021

(65) Prior Publication Data

US 2022/0106793 A1 Apr. 7, 2022

Related U.S. Application Data

(60) Provisional application No. 63/087,477, filed on Oct. 5, 2020.

(51) Int. Cl.
*E04C 5/12* (2006.01)
*B63B 21/27* (2006.01)

(52) U.S. Cl.
CPC ..... *E04C 5/122* (2013.01); *B63B 21/27* (2013.01)

(58) Field of Classification Search
CPC . E04C 5/12; E04C 5/122; E04C 5/125; E04C 5/127; E04G 21/147; B63B 2021/003; B63B 21/24; B63B 21/26; B66C 1/66; B66C 1/666; E04B 21/27; E02D 5/58; E02D 5/62
USPC ..... 52/125.1, 125.2; 294/215; 114/296
See application file for complete search history.

(56) References Cited

U.S. PATENT DOCUMENTS 3,496,900 A * 2/1970 Mott ..... B63B 21/27 114/296
3,861,106 A * 1/1975 Erhart ..... B66C 1/666 52/125.4
3,893,270 A 7/1975 Schupack et al.
4,173,856 A * 11/1979 Fricker ..... E04G 21/142 52/125.5

(Continued)

FOREIGN PATENT DOCUMENTS

GB 2017580 A 10/1979
WO 2014175751 A2 10/2014
WO 2020176262 A2 9/2020

OTHER PUBLICATIONS

Damiani, Rick et al. "3D Printed Concrete Suction Anchor (3DSA)",
Damiani, Rick et al. "3D Printed Concrete Suction Anchor (3DSA)", Poster presented at International Offshore Wind Partnering Forum (IPF), Providence, Rhode Island, Apr. 21-25, 2020, 1 pg.

(Continued)

*Primary Examiner* — William V Gilbert
(74) *Attorney, Agent, or Firm* — LOZA & LOZA, LLP

(57) ABSTRACT

The padeye according to the invention acts as an eyelet where the mooring line connects to the anchor. The three padeye embodiments disclosed herein are well suited for use with any concrete anchors, and in particular with any concrete suction anchor. The solutions provide connection mechanisms to the mooring and modalities that engage the concrete in a manner that is structurally safe and reliable; the padeye solutions are inexpensive to manufacture, and easy to transport, install, maintain, and replace.

13 Claims, 36 Drawing Sheets

SECTION B-B

(56) References Cited

U.S. PATENT DOCUMENTS

| | | | | |
|---|---|---|---|---|
| 5,666,768 | A * | 9/1997 | Gavin | H02G 9/025 52/21 |
| 8,024,896 | B2 * | 9/2011 | Azarin | B28B 23/005 52/125.4 |
| 10,626,626 | B2 * | 4/2020 | Barraclough | E04G 21/142 |
| 10,760,273 | B1 * | 9/2020 | Alexander | E04C 5/201 |
| 2006/0127187 | A1 * | 6/2006 | Raines | B63B 21/29 405/226 |
| 2007/0140796 | A1 * | 6/2007 | Alhayari | B63B 21/27 405/224.1 |
| 2009/0123235 | A1 * | 5/2009 | Maconochie | B63B 21/27 405/227 |
| 2012/0304554 | A1 * | 12/2012 | Sladojevic | E04G 21/142 52/125.4 |
| 2015/0275461 | A1 * | 10/2015 | Kwon | E02D 27/12 405/231 |
| 2021/0262227 | A1 * | 8/2021 | Hun | E04C 2/044 |

OTHER PUBLICATIONS

Damiani, Rick, Document submitted to National Science Foundation, PITCH (Aug. 15, 2019), 6 pgs.

PCT/IB2021/059129, International Search Report, Feb. 2, 2022, 9 pgs.

* cited by examiner

SECTION D-D

SECTION B-B

SECTION C-C

SECTION A-A exraction operational embedment sinking

PADEYE, CONNECTIONS, AND MOORING SOLUTION FOR CONCRETE ANCHORS

TECHNICAL FIELD

The present invention concerns a padeye configured to be attached to a suction anchor, wherein the suction anchor is made of any material, for instance steel or concrete, wherein the padeye is applicable to many different environmental settings, easy and inexpensive to manufacture, transport, install, maintain and replace.

In the following, the padeye according to the invention will be described with reference to several variants of a concrete suction anchor provided with post-tensioning tendons. However, it must be understood that the embodiments of the padeye according to the invention can be attached to any suction anchor, still remaining in the scope of protection of the invention as defined in the attached claims.

BACKGROUND

Oil and gas and renewable energy floating systems benefit from anchoring for station keeping during operation, power production, and parked/idling conditions. Fundamentally, anchors can be subdivided into two major classes: horizontal and vertical load anchors. The horizontal-load anchors are normally used in combination with catenary mooring, where the mooring line is tangent to the seabed before connecting to the anchor.

Gravity anchors (vertical load) can include large concrete blocks with optional skirts to increase the sliding resistance. However, they suffer from the drawback of having poor efficiency, namely lower than 1 because they can only withstand loads less than their weight. They also require vessels with heavy lift capabilities for transportation and installation.

Drag embedment anchors (horizontal load) offer extremely large lateral resistance and therefore are considered of efficiencies higher than 1, i.e., they can withstand loads larger than their weight. However, they suffer from the drawback of having an extremely poor vertical load resistance. Therefore, they are generally not used with semi-taut or taut mooring.

Plate anchors for vertical and horizontal loads, which are a variation of drag embedment anchors, are installed edgewise and then rotated by pulling the chain until they face broadsided to the uplift, maximizing the uplift resistance. Suction embedded plated anchors are another variation of the drag embedment anchors and they use a suction pile to get driven to the correct depth, and then they open up to offer maximum resistance to uplift (e.g., as disclosed at www.spt-offshore.com). Similarly, to drag-anchors, they must be shape-optimized with relatively complex kinematics to induce the proper embedment and thus installation is expensive. Furthermore, it does not seem possible to replace the steel with other materials for this type of anchor. Another variant involves lateral-load anchors. These plates can be driven edgewise with suction piles that are then removed (e.g., as disclosed at www.intermoor.com). Again, installation is a critical and expensive phase of this system.

Prior art pile anchors for horizontal and vertical load are made of rolled and welded steel plates, and with typical aspect ratio of length-to-diameter higher than 10 and diameters of up to 2 meters. Underwater hammers are normally needed, or pile followers must be used to drive piles from the surface. If the solid stratigraphy reveals presence of rock, pre-drilled sockets and post installation grouting becomes necessary. Again, the installation of these piles is expensive, requiring specialized offshore equipment and lengthy operations. In soft soils, an alternative is offered by suction piles, with lower length-to-diameter ratios than driven piles, and diameters that can reach 10 m. They use hydrostatic pressure to embed and are expensive to manufacture. They can be removed by reversing the suction process. Piles can withstand both vertical, mainly through friction, and lateral loading, namely through soil pressure along the outer surface of the embedment pile. Therefore, semi-taut and taut mooring is possible with piles. Suction piles or suction anchors could be made of reinforced concrete.

The suction anchors are provided with at least one padeye configured to be attached to towing cables and/or chain for transportation, installation, maintenance and operational reasons.

However, prior art padeye are neither easily, effectively and inexpensively applicable to existing suction anchors, especially to existing concrete suction anchors, nor easy and inexpensive to manufacture, transport, install, maintain and replace.

Embodiments of the present invention provide solutions for these outstanding needs.

SUMMARY OF THE INVENTION

It is specific subject-matter of the present invention a padeye according to the attached claims.

The padeye according to the invention, that is configured to be attached to any suction anchors is applicable to many different environmental settings, easy and inexpensive to manufacture, transport, install, maintain and replace.

BRIEF DESCRIPTION OF THE DRAWINGS

The present invention will be now described, by way of illustration and not by way of limitation, according to its preferred embodiments, by particularly referring to the Figures of the annexed drawings, in which.

of a fourth variant of the concrete suction anchor to which the padeye according to the invention is attached.

Figure 5:
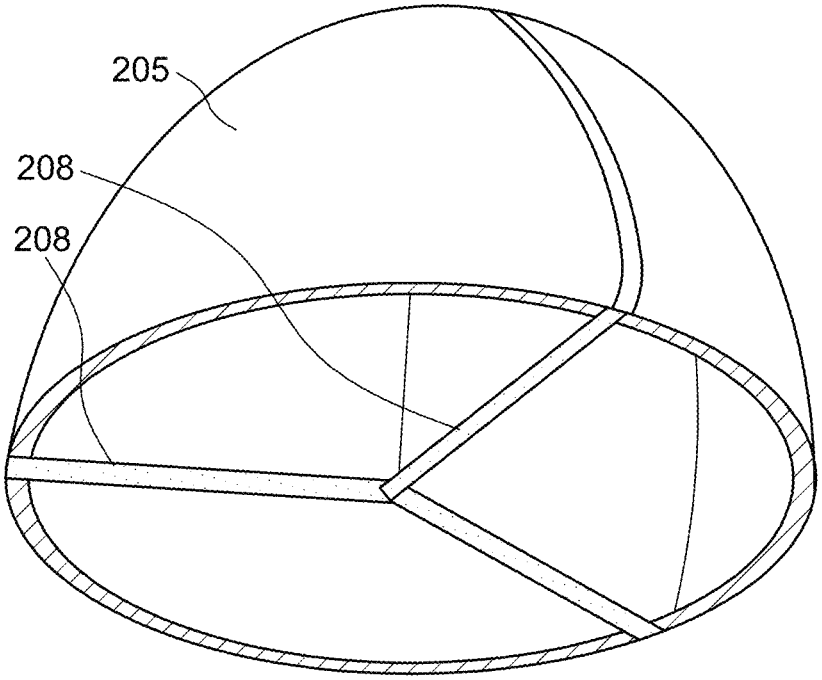

FIG. 5 shows a perspective view of a top dome of a fifth variant of the concrete suction anchor to which the padeye according to the invention is configured to be attached.

Figure 6A:
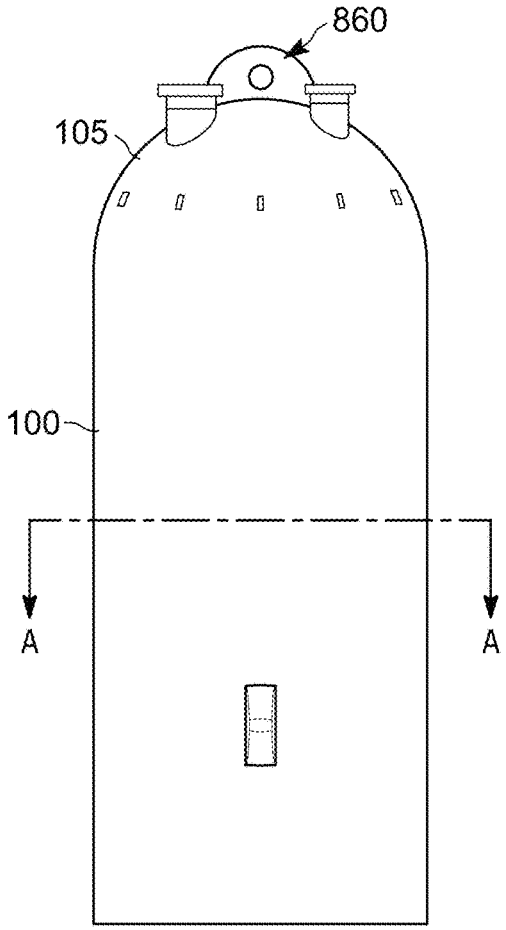
Figure 6B:
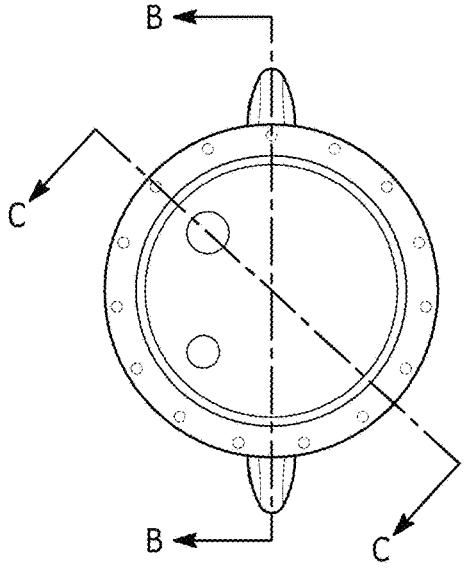
Figure 6C:
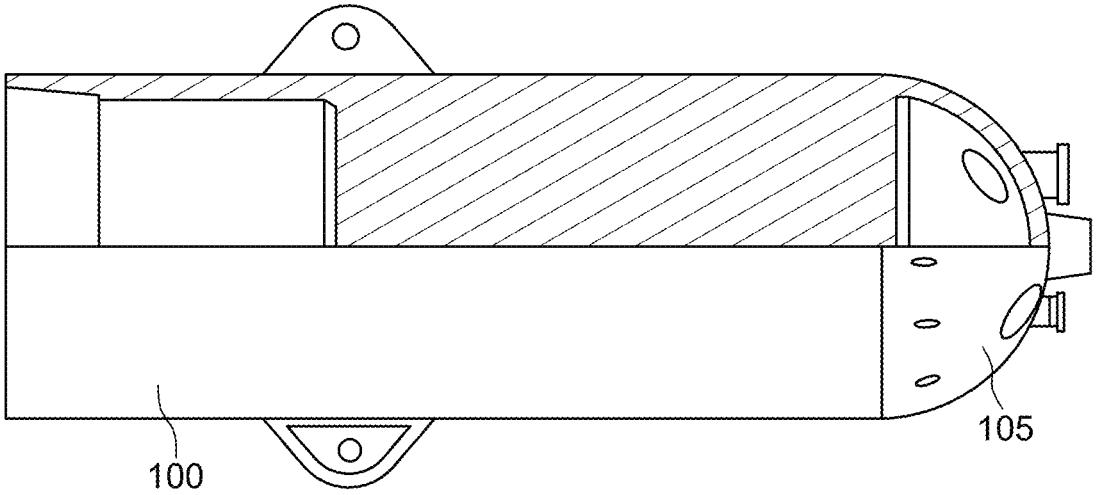

FIG. 6 shows a side view (FIG. 6*a*), a top plan view (FIG. 6*b*), a side view partly in section according to plane BB of FIG. 6*b* (FIG. 6*c*), a sectional view according to plane CC of FIG. 6*b* (FIG. 6*d*), a perspective view (FIG. 6*e*), and a sectional view according to plane AA of FIG. 6*a* (FIG. 6*f*) of a sixth variant of the concrete suction anchor to which the padeye according to the invention is attached.

FIG. 7 schematically shows four operating conditions of a concrete suction anchor to which the padeye according to the invention is configured to be attached.

FIG. 8 schematically shows three modes of wet-towing of the concrete suction anchor to which the padeye according to the invention is attached.

FIG. 9 schematically shows additional three modes of wet-towing of the concrete suction anchor to which the padeye according to the invention is attached.

FIG. 10 schematically shows the operating condition of sinking of the concrete suction anchor to which the padeye according to the invention is configured to be attached.

FIG. 11 schematically shows the operating condition of embedment of the concrete suction anchor to which the padeye according to the invention is configured to be attached.

FIG. 12 schematically shows the operating condition of disembedment of the concrete suction anchor to which the padeye according to the invention is configured to be attached.

Figure 13B:
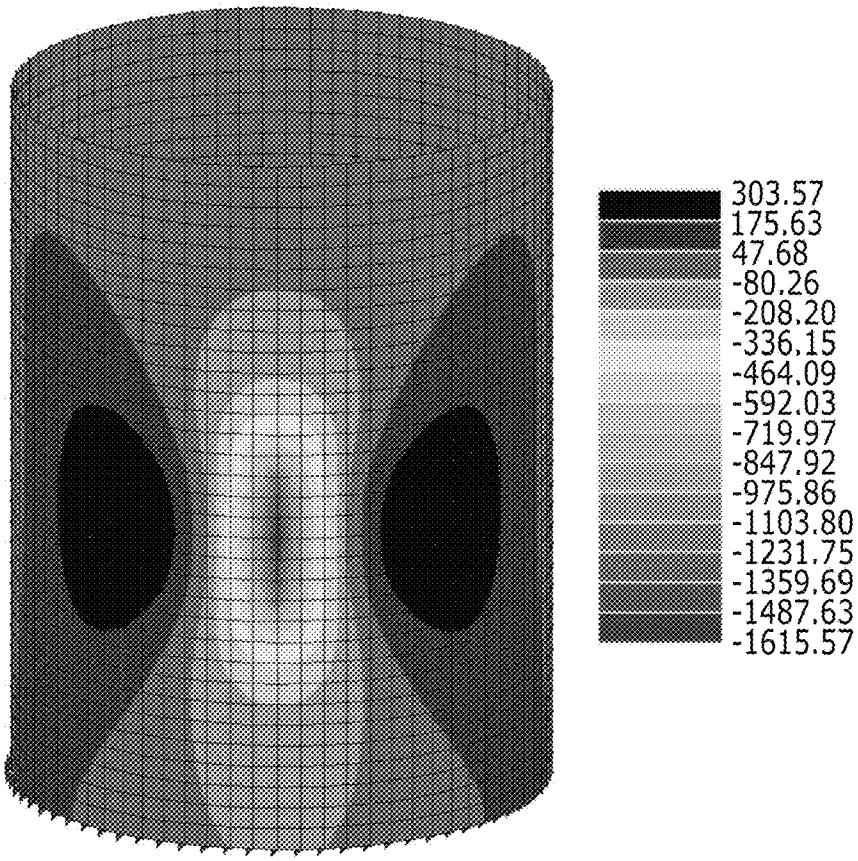
Figure 13A:
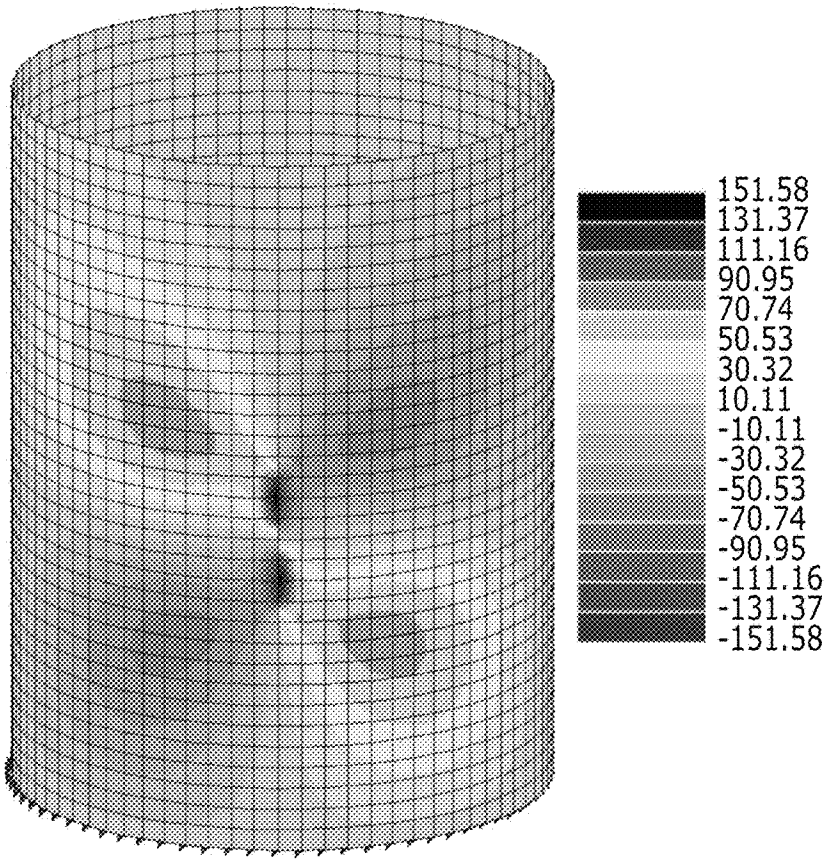

FIG. 13 shows results of simulations of stress concentrations on a padeye location of a prior art suction anchor.

Figure 14:
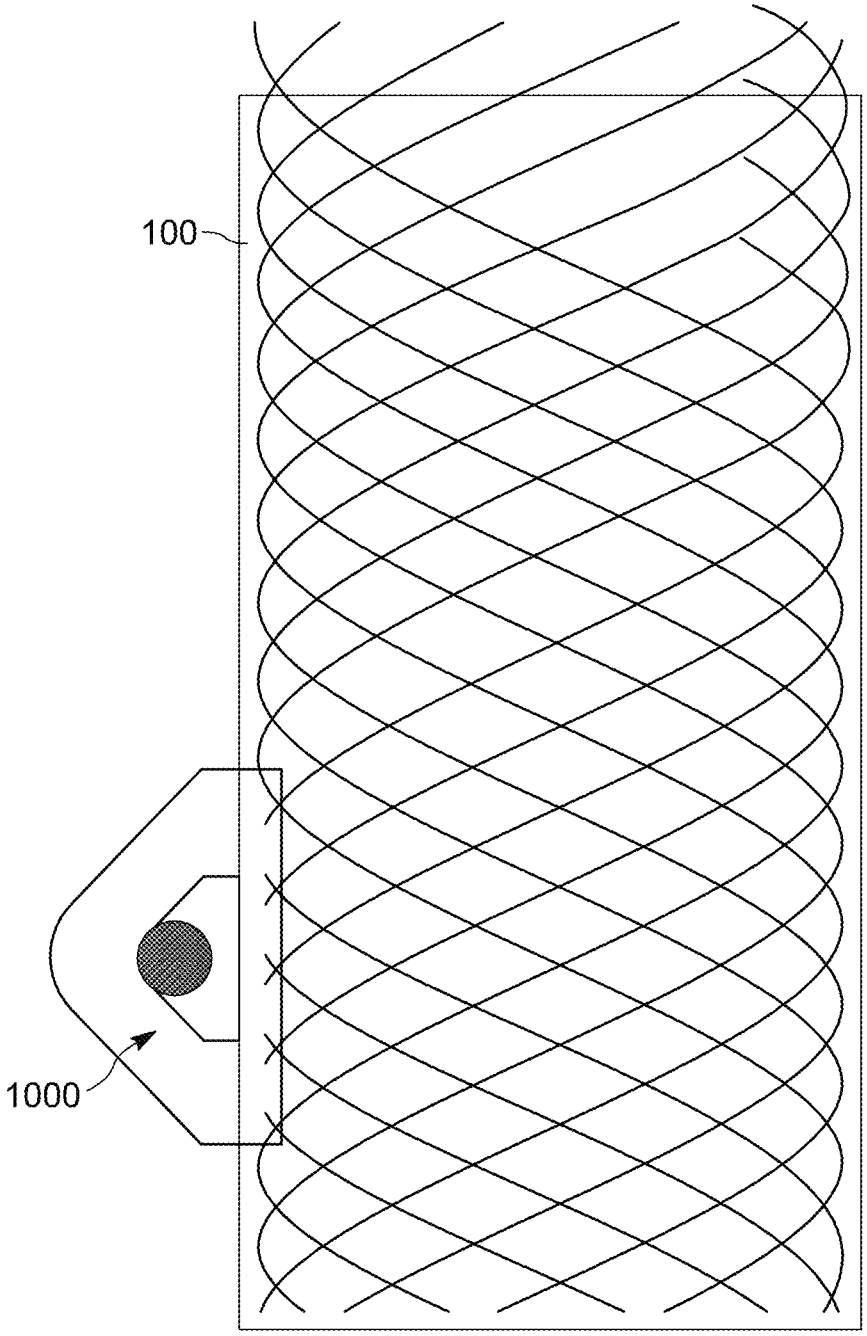

FIG. 14 shows a detail of a seventh variant of the concrete suction anchor to which a first embodiment of the padeye according to the invention is attached.

Figure 15:
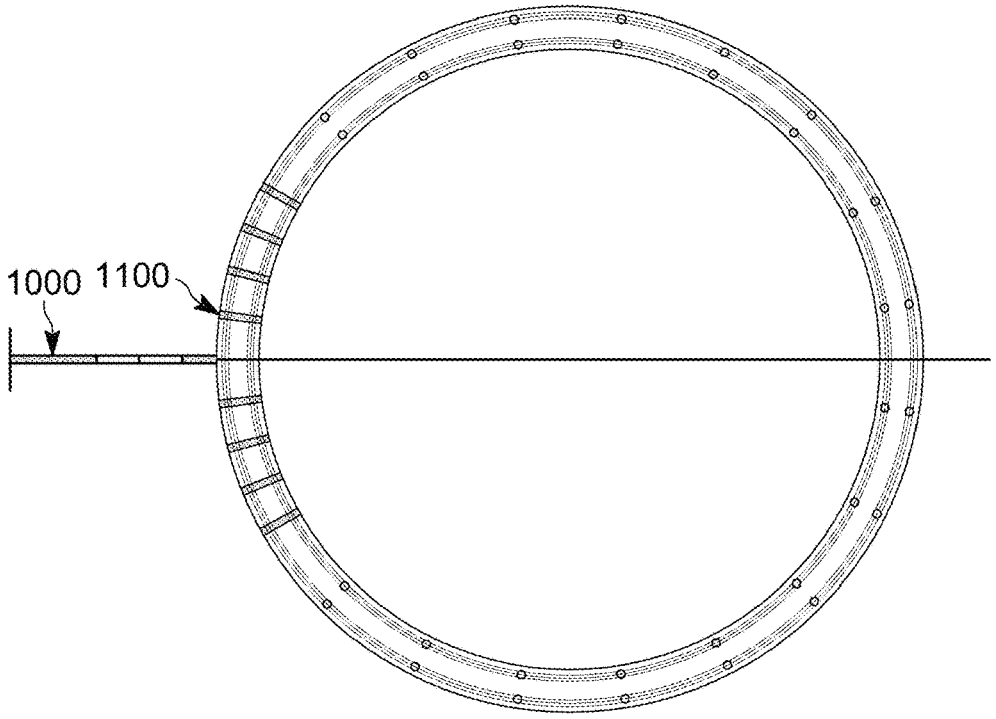

FIG. 15 shows a sectional view along a plane orthogonal to the longitudinal axis of the concrete suction anchor of FIG. 14.

Figure 16:
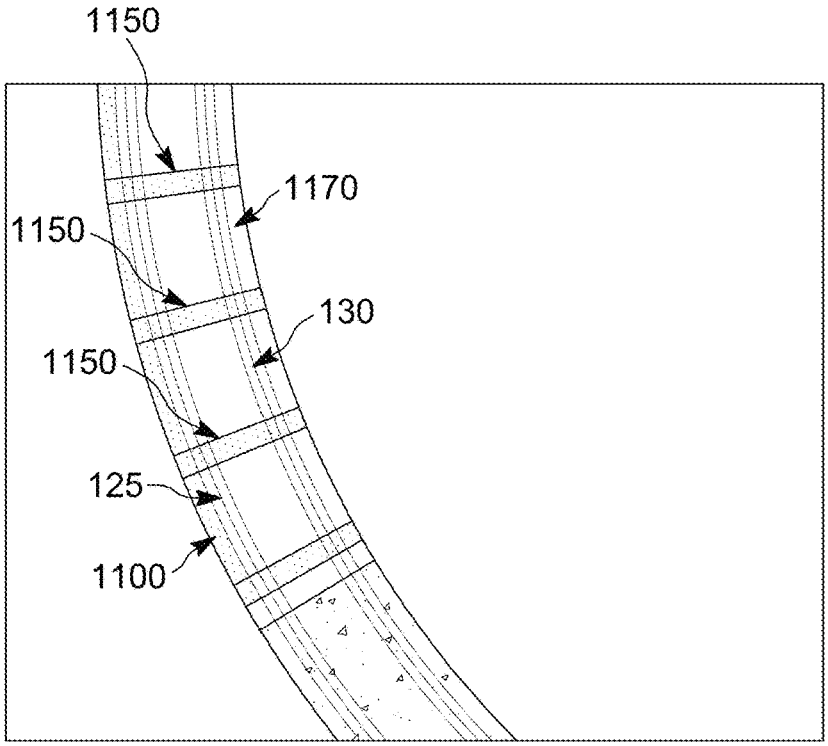

FIG. 16 shows a enlarged portion of the sectional view of FIG. 15.

Figure 17:
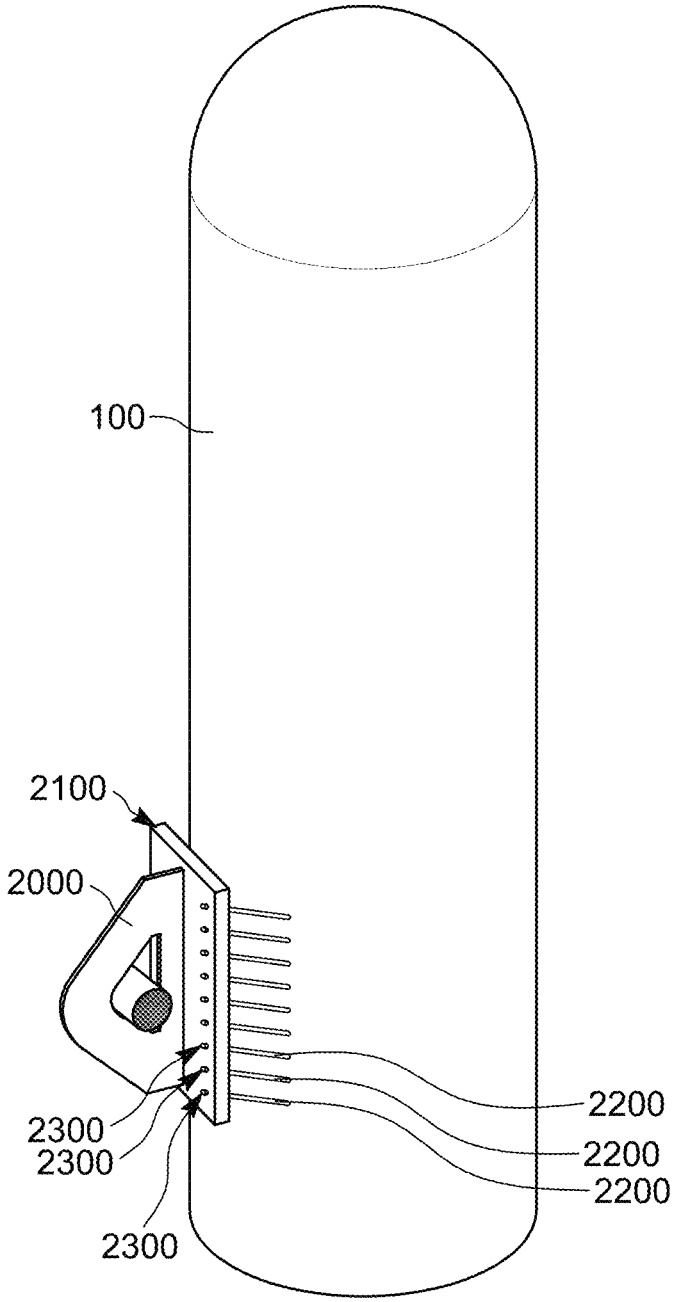

FIG. 17 shows a perspective view of an eighth variant of the concrete suction anchor to which a second embodiment of the padeye according to the invention is attached.

Figure 18A:
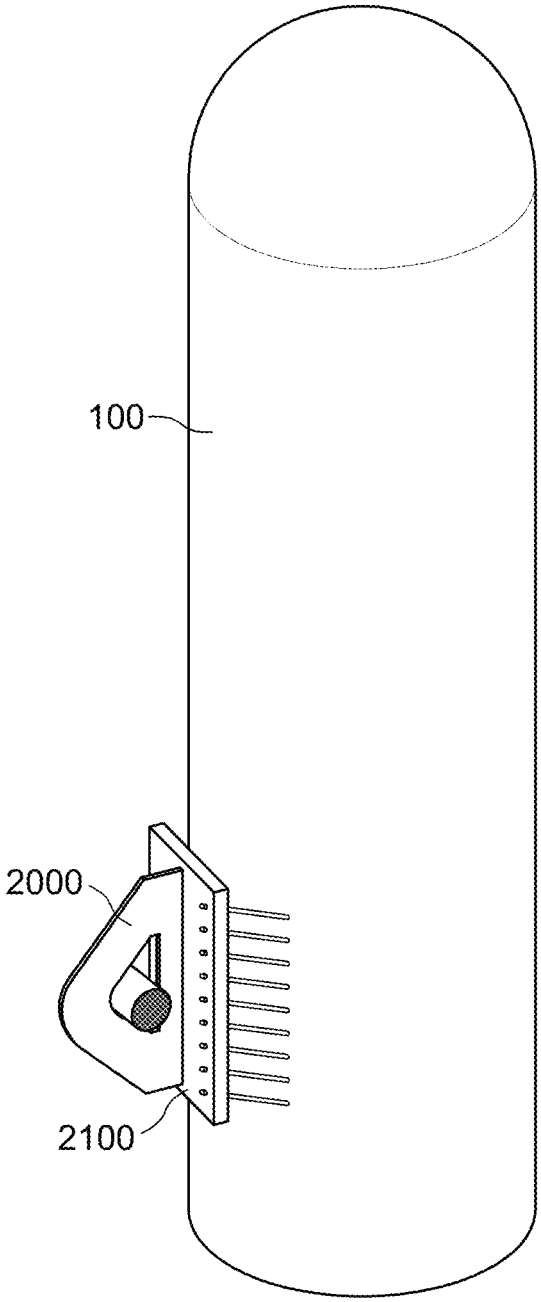
Figure 18B:
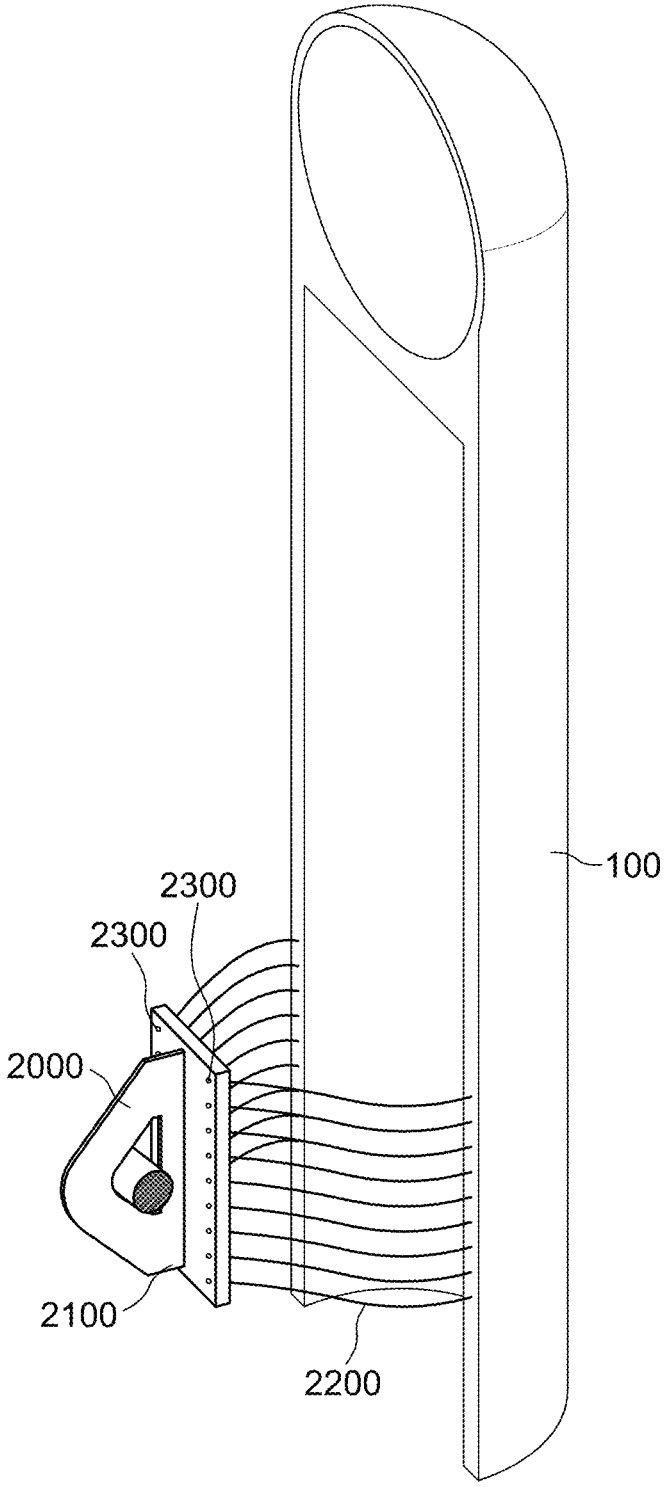
Figure 18C:
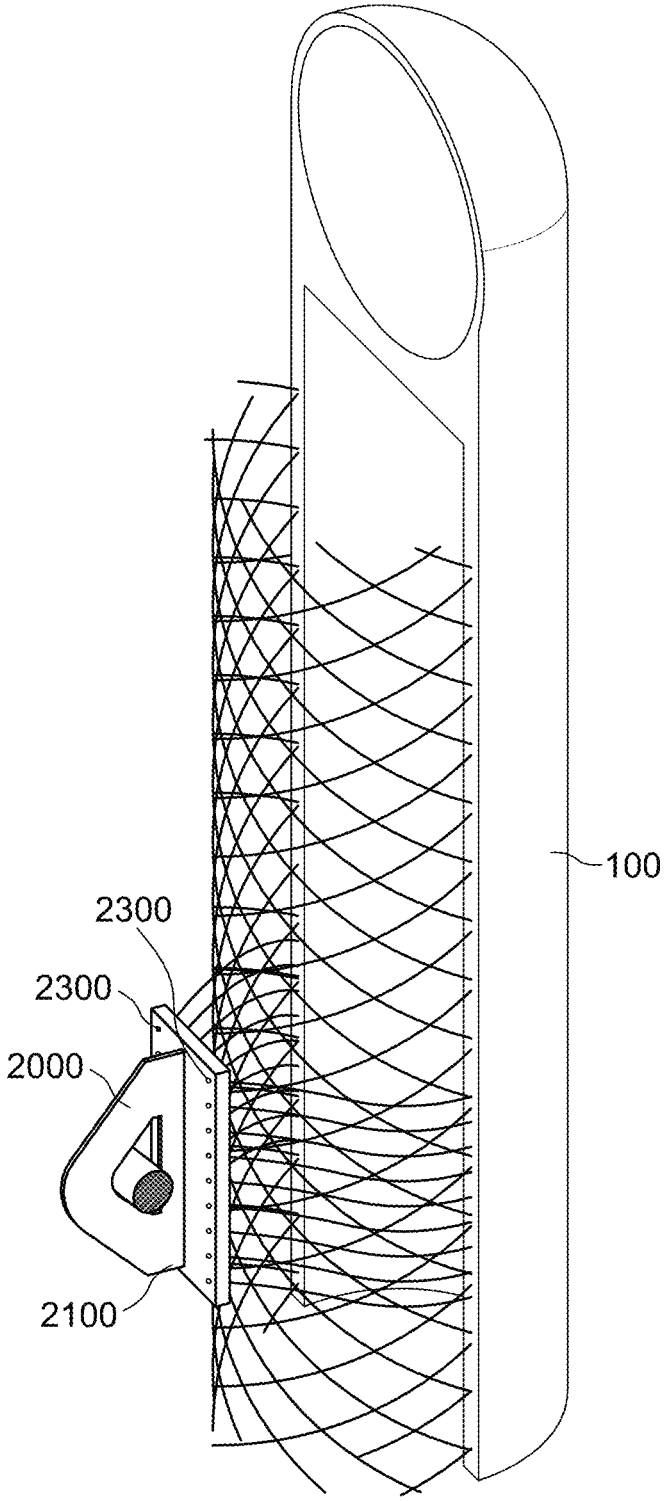

FIG. 18 shows a sectional perspective view along a plane parallel to and passing through the longitudinal axis of the concrete suction anchor of FIG. 17 wherein the whole post-tensioning tendons are visible (FIG. 18*a*), the sectional perspective view of FIG. 18*a* not showing post-tensioning tendons (FIG. 18*b*), and a perspective view of the concrete suction anchor of FIG. 17 (FIG. 18*c*).

Figure 19:
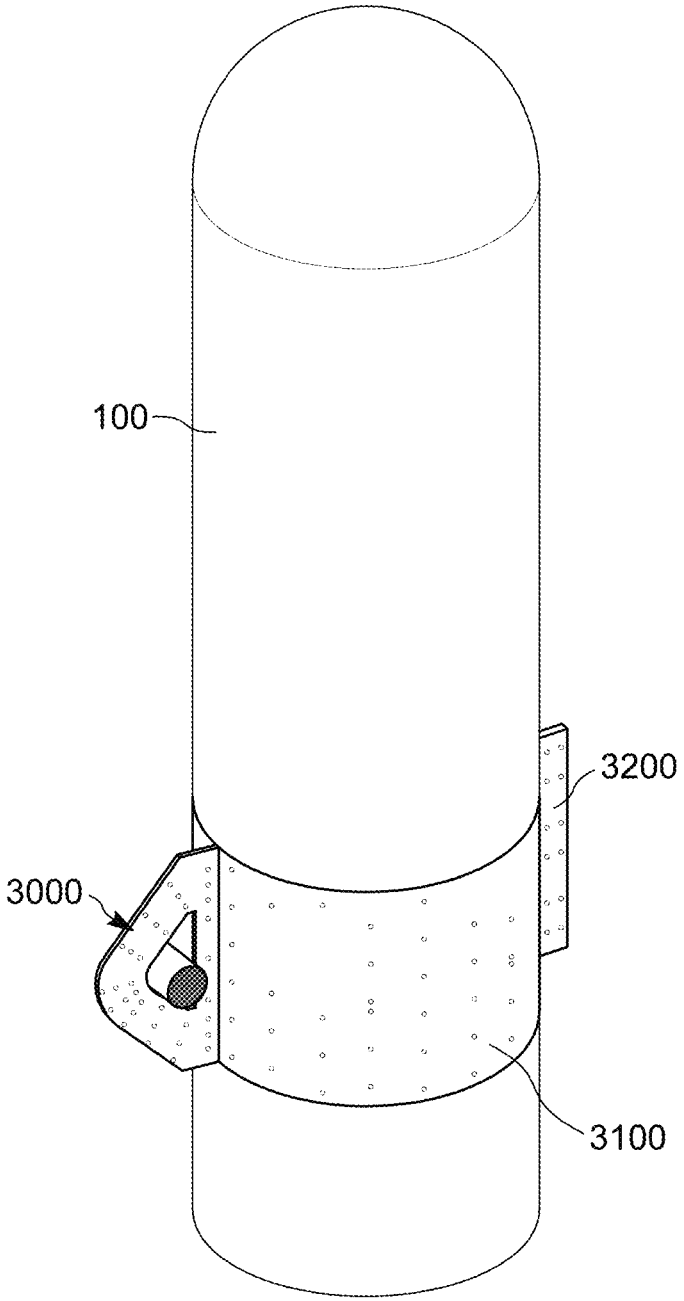

FIG. 19 shows a perspective view of a ninth variant of the concrete suction anchor to which a third embodiment of the padeye according to the invention is attached.

Figure 20A:
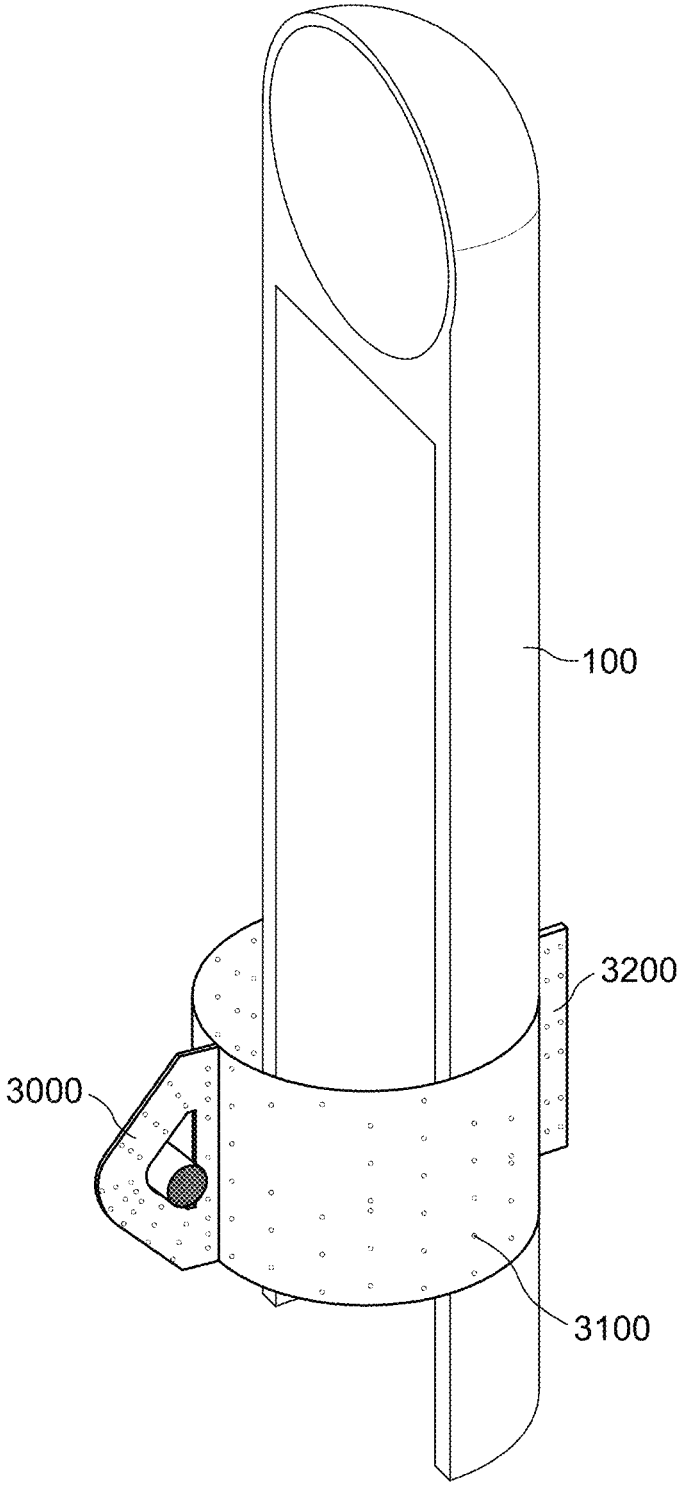
Figure 20B:
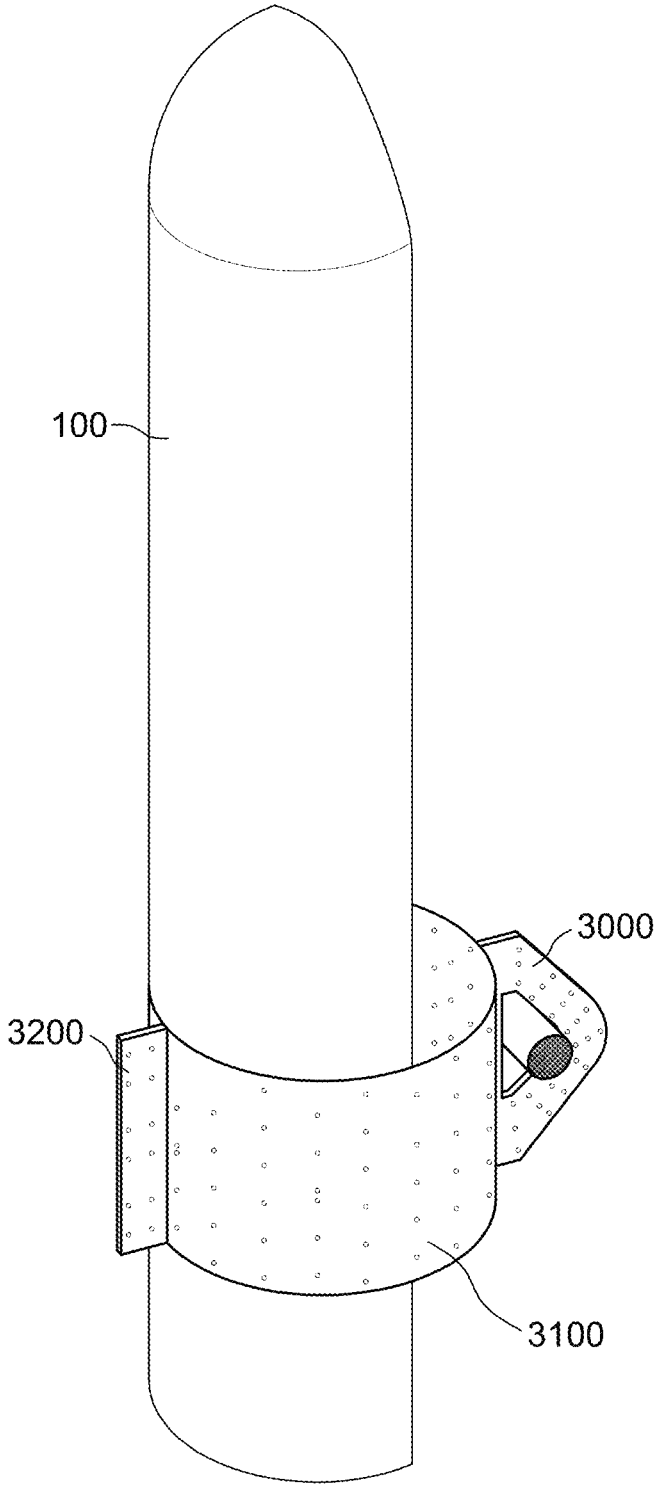
Figure 20C:
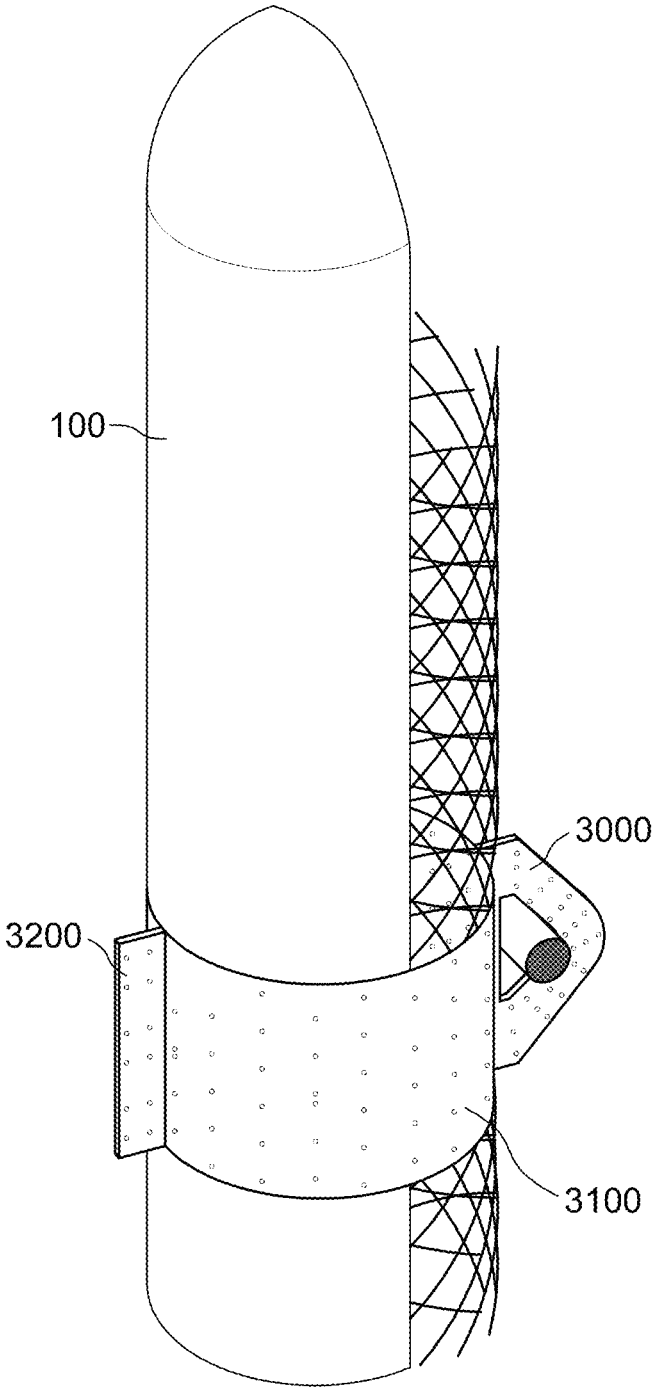
Figure 20D:
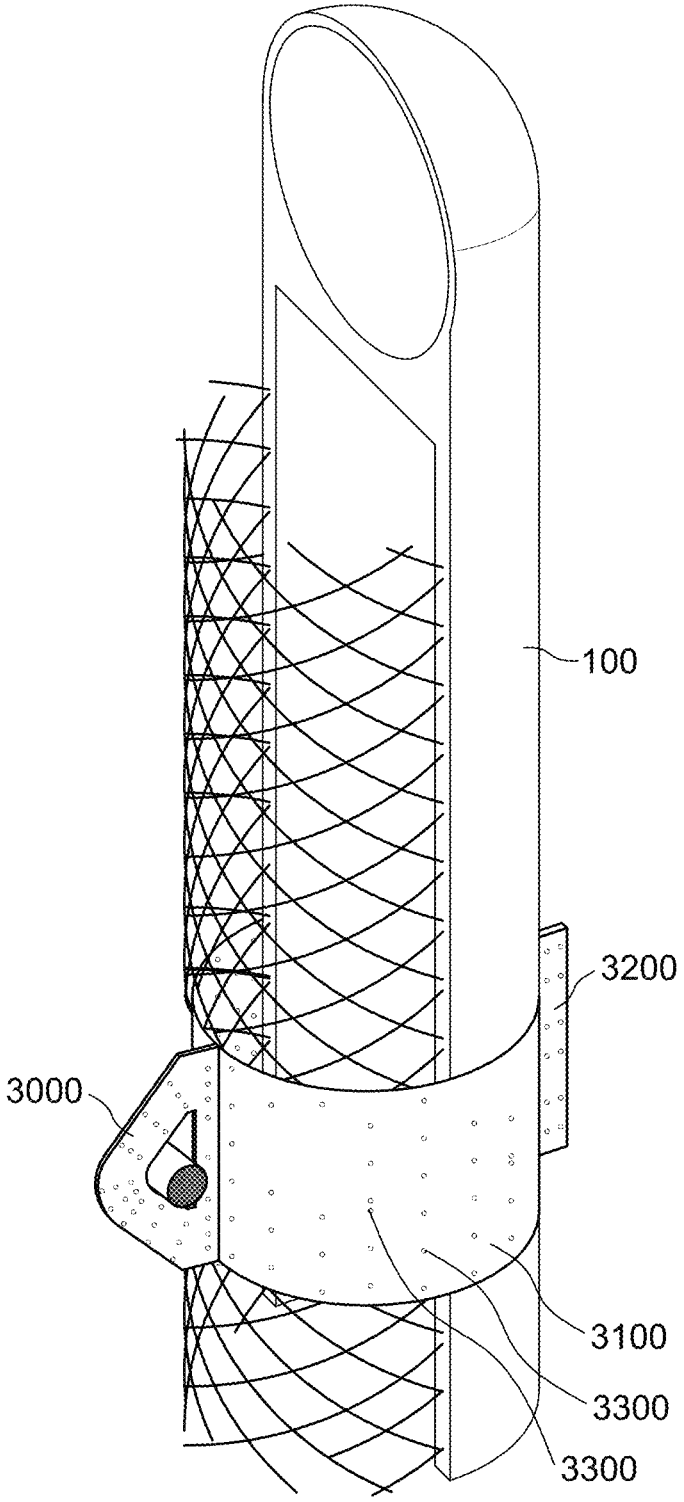
Figure 20E:
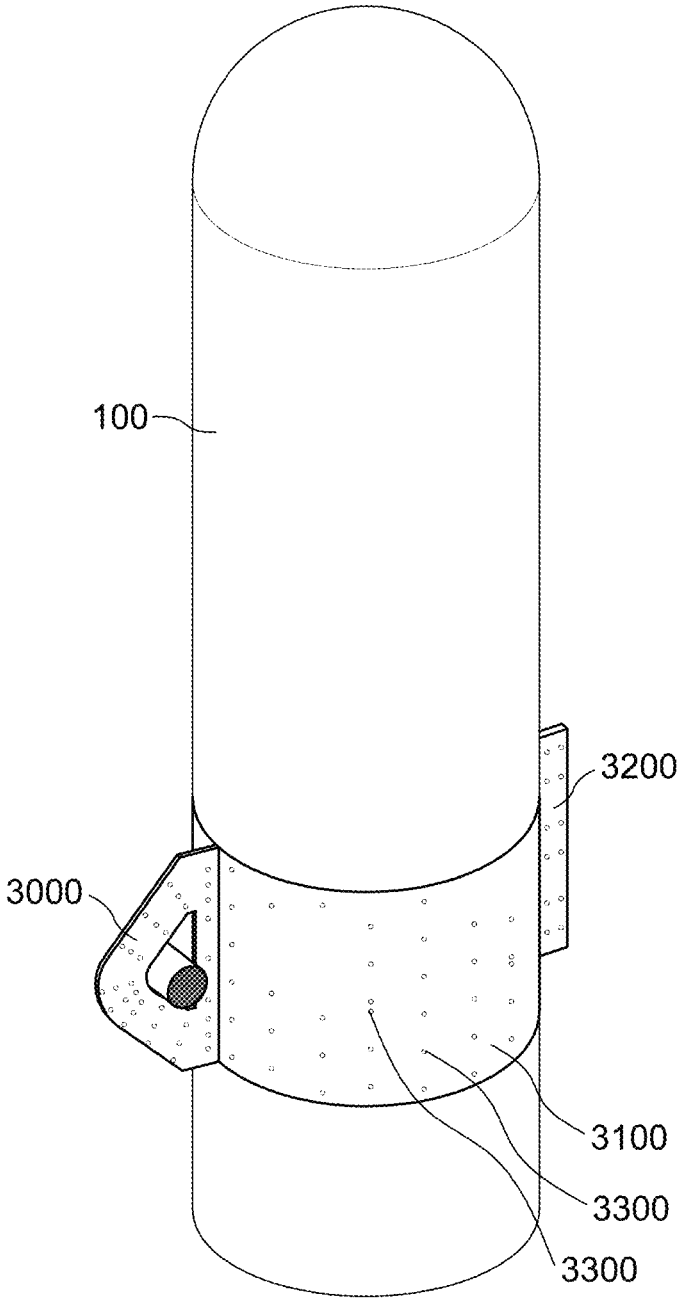

FIG. 20 shows a perspective view of the concrete suction anchor of FIG. 19 (FIG. 20*a*), a front sectional perspective view along a plane parallel to and passing through the longitudinal axis of the concrete suction anchor of FIG. 19 wherein the whole post-tensioning tendons are visible (FIG. 20*b*), a rear sectional perspective view corresponding to FIG. 20*b* (FIG. 20*c*), the rear sectional perspective view of FIG. 20*c* not showing post-tensioning tendons (FIG. 20*d*), and the front sectional perspective view of FIG. 20*b* not showing post-tensioning tendons (FIG. 20*e*).

Figure 21A:
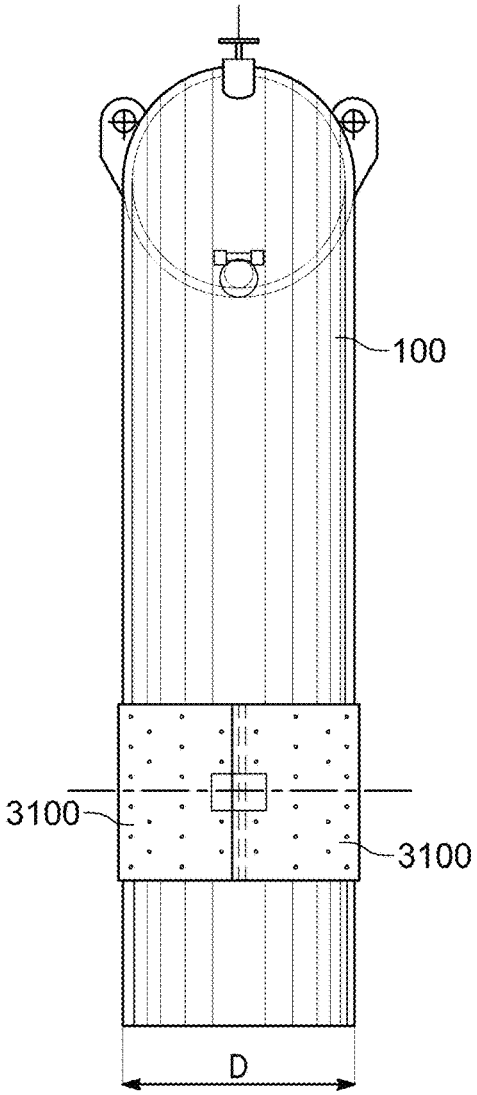
Figure 21B:
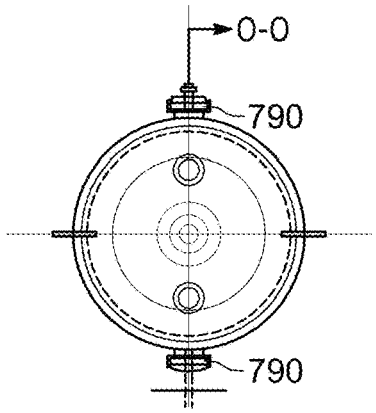
Figure 21C:
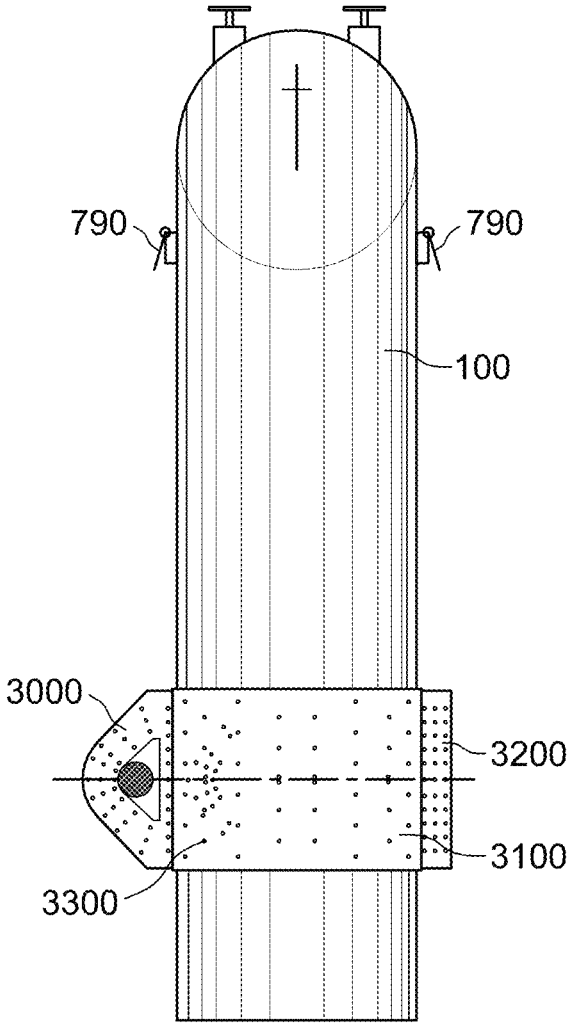
Figure 21D:
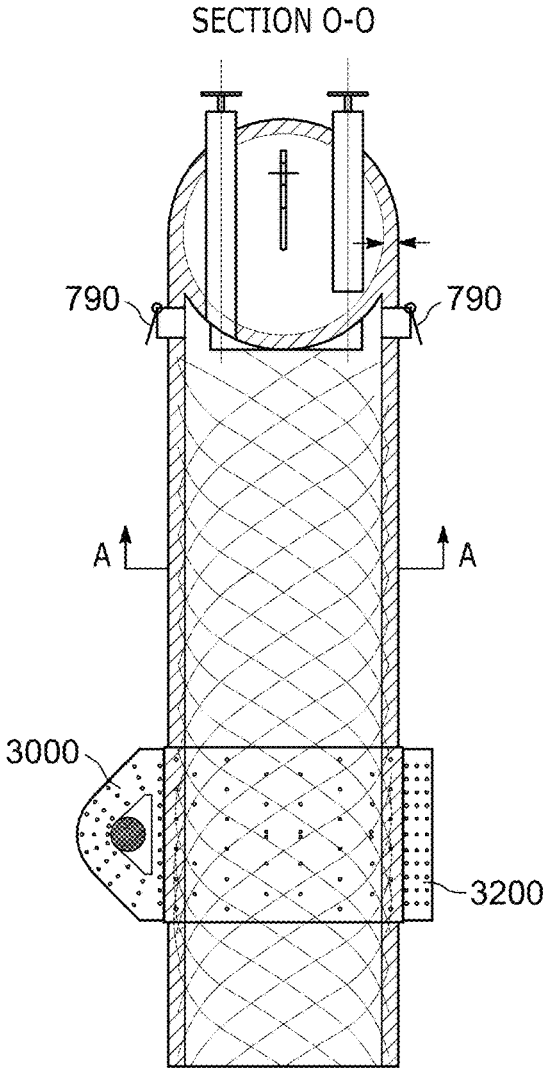
Figure 21E:
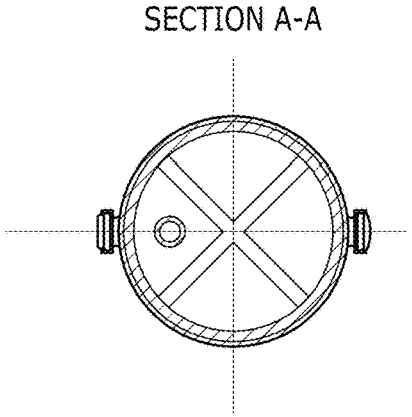

FIG. 21 shows a front view (FIG. 21*a*), a top plan view (FIG. 21*b*), a left side view (FIG. 21*c*), a sectional view according to plane OO of FIG. 21*b* (FIG. 21*d*), and a sectional view according to plane AA of FIG. 21*d* (FIG. 21*e*) of a tenth variant of the concrete suction anchor to which the third embodiment of the padeye according to the invention is attached.

In the Figures identical reference numerals will be used for alike elements.

DETAILED DESCRIPTION OF THE INVENTION

As already stated, the padeye according to the invention will be described in the following with reference to several variants of a concrete suction anchor provided with post-tensioning tendons. However, it must be understood that the embodiments of the padeye according to the invention can be attached to any suction anchor, still remaining in the scope of protection of the invention as defined in the attached claims.

Making reference to FIG. 1, the first variant of the concrete suction anchor includes a cylindrical structure 100, open at a bottom end and closed by a top dome 105 at the top end. The top dome 105 defines an internal buoyancy chamber 110 having a substantially spherical shape. The internal buoyancy chamber 110 is separated from the main cavity 115 of the cylindrical structure 100 of the concrete suction anchor by a bottom surface provided with top stiffeners 120 evenly angularly distributed over the circular cross section of the cylindrical section 100, the top edge of which top stiffeners 120 follows the bottom surface of the internal buoyancy chamber 110. The lateral cylindrical wall of the concrete suction anchor, namely the lateral cylindrical wall of the cylindrical structure 100 thereof defining the main cavity 115 open at the bottom end, includes a plurality of internal channels housing a pair of sets of post-tensioning tendons: a first set of post-tensioning tendons 125 and a second set of post-tensioning tendons 130. The longitudinal axis of the cylindrical structure 100 is also the longitudinal axis of the concrete suction anchor.

The post-tensioning tendons 125 of the first set, and related housing internal channels of the cylindrical structure 100, are arranged according to a three-dimensional (3D) helicoidal arrangement, i.e. a 3D spiral arrangement, wherein each post-tensioning tendon 125 is inclined with respect to the longitudinal axis of the concrete suction anchor by an angle that can be finely adjusted depending on the specific application of the concrete suction anchor, that for common applications is typically equal to 45° (i.e., +45° considering a positive angle the one that is defined going counterclockwise from the longitudinal axis of the concrete suction anchor to the post-tensioning tendon 125). The post-tensioning tendons 130 of the second set, and related housing internal channels of the cylindrical structure 100, are arranged according to a three-dimensional (3D) helicoidal arrangement, i.e. a 3D spiral arrangement, wherein each post-tensioning tendon 130 is inclined with respect to the longitudinal axis of the concrete suction anchor by an opposite angle with respect to the inclination angle of the post-tensioning tendon 125, that for common applications is typically equal to 45° in the opposite direction than the post-tensioning tendons 125 of the first set (i.e., each post-tensioning tendon 130 is inclined with respect to the longitudinal axis of the concrete suction anchor by −45° considering a negative angle the one that is defined going clockwise from the longitudinal axis of the concrete suction anchor to the post-tensioning tendon 130).

The two sets of post-tensioning tendons introduce compressive stresses into the concrete suction anchor to reduce tensile stresses resulting from applied loads including the self weight of the anchor itself, also known as dead load. In particular, the two sets of post-tensioning tendons are arranged so as to counter-rotate around the longitudinal axes of the concrete suction anchor for cancelling any tangential stresses related to the post-tensioning and for inserting axial and circumferential stresses which are opposed to those due to the load during usual operation.

It must be noted that other variants of the concrete suction anchor can have the first set of post-tensioning tendons 125 and the second set of post-tensioning tendons 130 which are arranged differently from a three-dimensional (3D) helicoidal arrangement, e.g. because no post-tensioning tendons defines any helix along the cylindrical structure 100, and/or which are neither parallel nor orthogonal to the longitudinal axis of the concrete suction anchor, thereby the first set of post-tensioning tendons 125 and the second set of post-tensioning tendons 130 are inclined with respect to the longitudinal axis of the concrete suction anchor by opposite angles even different from 45°, namely by any angle larger than 0° and lower than 90°, optionally larger than 15° and lower than 75°, more optionally larger than 30° and lower than 60°, still remaining within the scope of protection of the present invention.

Further, it must be noted that other variants of the concrete suction anchor can have more than one pair of counter rotating sets of post-tensioning tendons, still remaining within the scope of protection of the present invention.

The concrete suction anchor can be manufactured through 3D concrete printing or other manufacturing technique such as precasting or on-site casting. Advantageously, the cylindrical structure 100 of the concrete suction anchor can be formed by two or more cylindrical modules, optionally pre-cast ones, the lateral cylindrical wall of each one of which includes a plurality of internal passages, each of which forms a section of an internal channel configured to house a section of a related post-tensioning tendons; in this case, the ends of the plurality of internal passages of a cylindrical module are aligned with those of adjacent cylindrical modules) so as to form the plurality of internal channels. After post-tensioning, the post-tensioning tendons firmly maintain said two or more cylindrical modules together to form the cylindrical structure 100 of the concrete suction anchor.

Advantageously, the post-tensioning tendons 125 and 130 are made of steel, such as ultra-high-strength steel strands, and post-tensioning is applied thereto by conventional anchorage wedges placed at the ends of each internal channel, e.g., at ring plates fixed at the ends of the cylindrical structure 100 of the concrete suction anchor. To apply the proper amount of compressive stresses into the concrete suction anchor by means of the post-tensioning tendons 125 and 130, it is sufficient to carry out conventional examinations in all operating conditions at the service limit state, ultimate limit state, fatigue limit state on the concrete (both the most compressed part and the minimally compressed or possibly tensioned part), on non-prestressed steel (maximum tension action) and on prestressing cables (maximum tension action). Advantageously, both effects similar to the beam-like behavior of the whole concrete suction anchor and shell-like behavior on the walls thereof due to internal and external pressures are taken into account; also, local effects due to concentrated loads (such as those applied on the padeye area) are taken into consideration. In particular, the proper amount of compressive stresses into the concrete suction anchor by means of the post-tensioning tendons 125 and 130 may be determined as disclosed by G. T. Houlsby and B. W. Byrne in «*Design Procedures for installation of suction caissons in clay and other materials*», Proceedings of the Institution of Civil Engineers—Geotechnical Engineering, Vol. 159, issue 3, 1 Jul. 2005, by the authors of "*Suction Installed Caisson Foundations for Offshore Wind: Design Guidelines*» February 2019, and by J. D. Murff and J. M. Hamilton in «*P-ultimate for undrained analysis of laterally loaded piles*», Journal of Geotechnical Engineering, vol. 119, issue 1, January 1993.

Figure 1A:
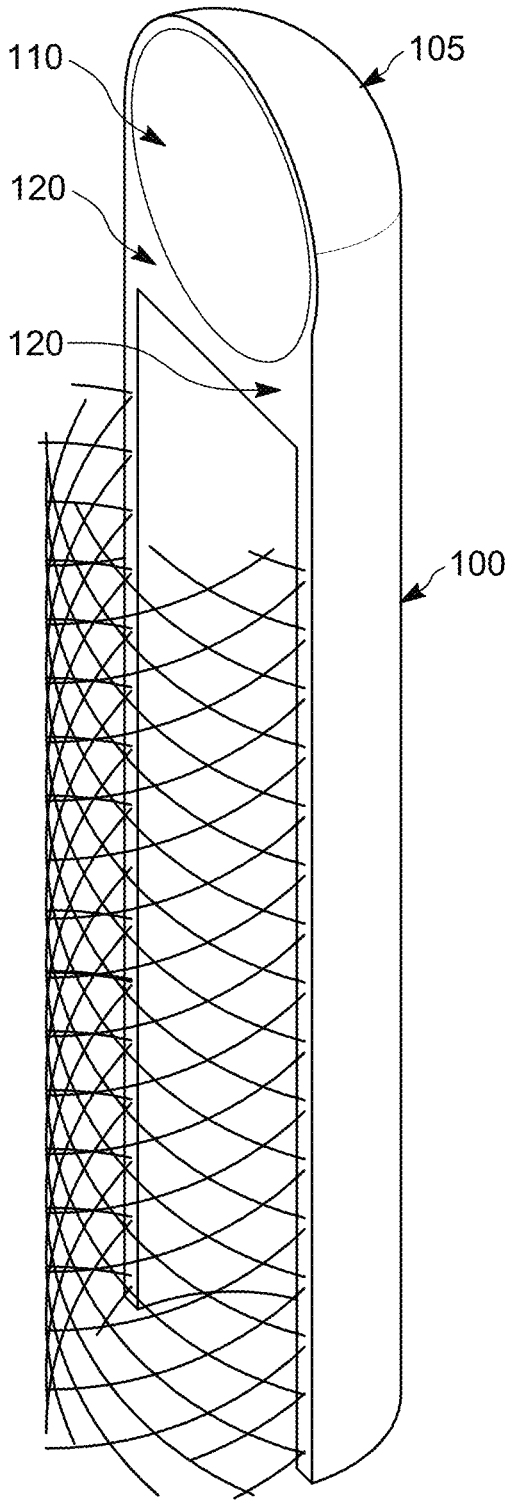
FIG. 1 shows a first variant of a concrete suction anchor to which the padeye according to the invention is configured to be attached, namely a sectional perspective view along a plane parallel to and passing through the longitudinal axis of the concrete suction anchor wherein the whole post-tensioning tendons are visible (FIG. 1*a*), the sectional perspective view of FIG. 1*a* not showing post-tensioning tendons (FIG. 1*b*), a perspective view of the post-tensioning tendons of the concrete suction anchor (FIG. 1*c*), a sectional perspective view along a plane parallel to and passing through the longitudinal axis of a first set of the post-tensioning tendons (FIG. 1*d*) and the opposed sectional perspective view of a second set of the post-tensioning tendons (FIG. 1*e*).
Figure 1B:
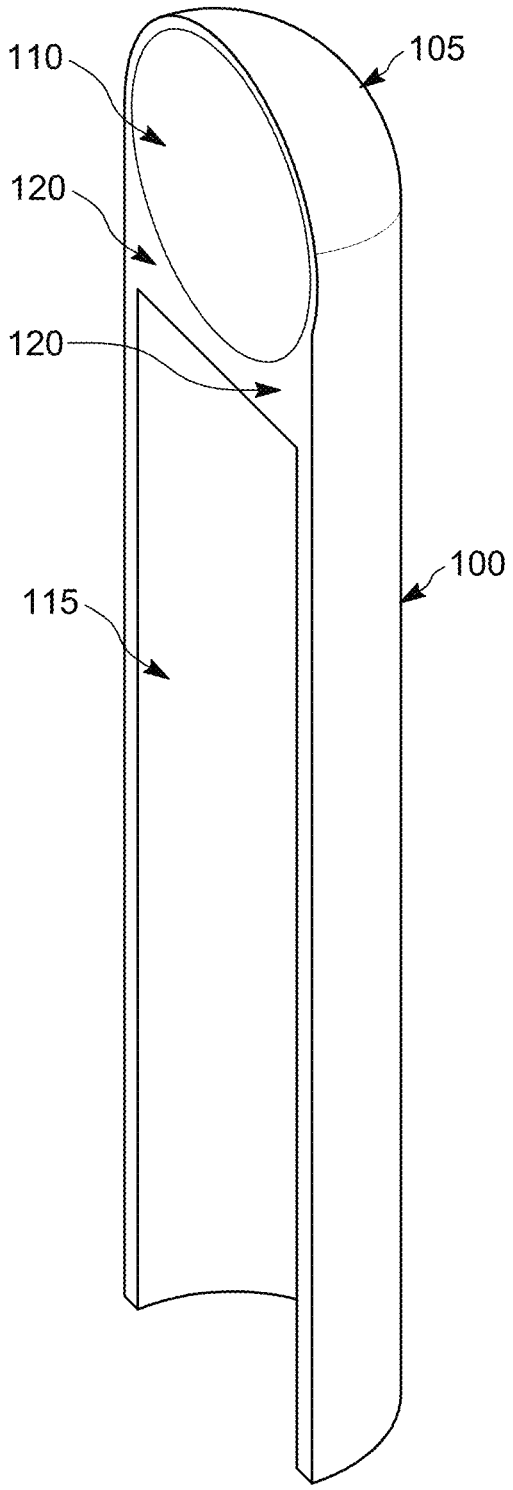
Figure 1C:
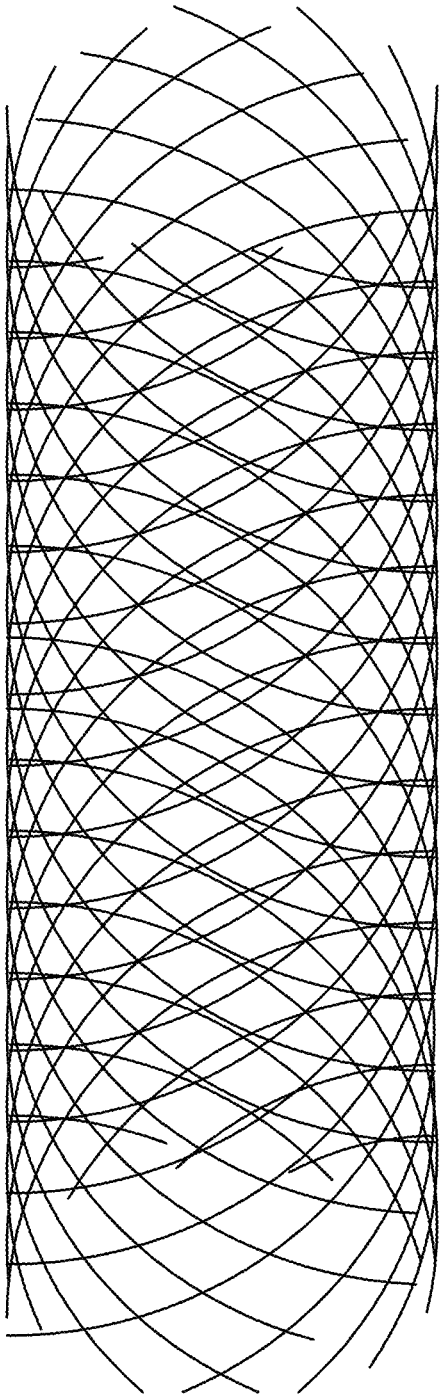
Figure 1D:
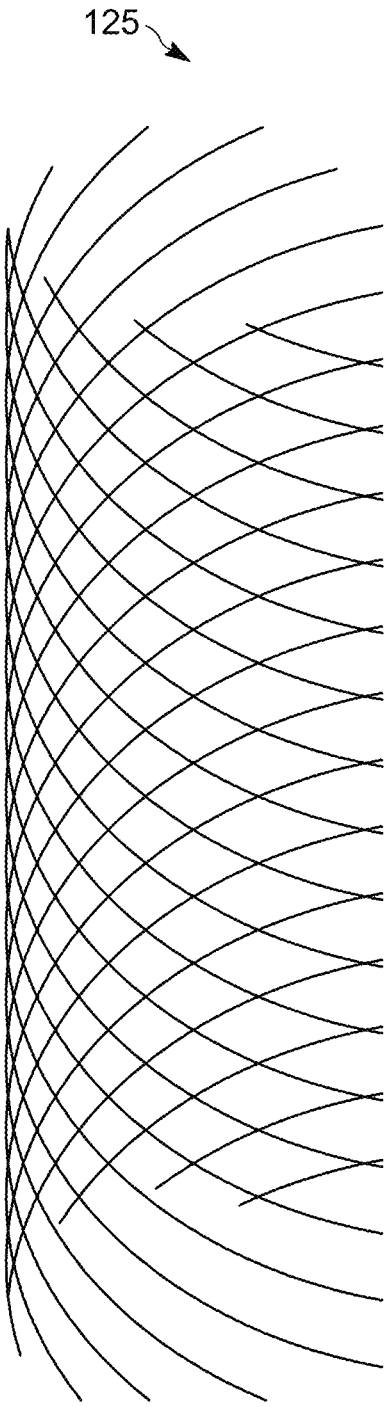
Figure 1E:
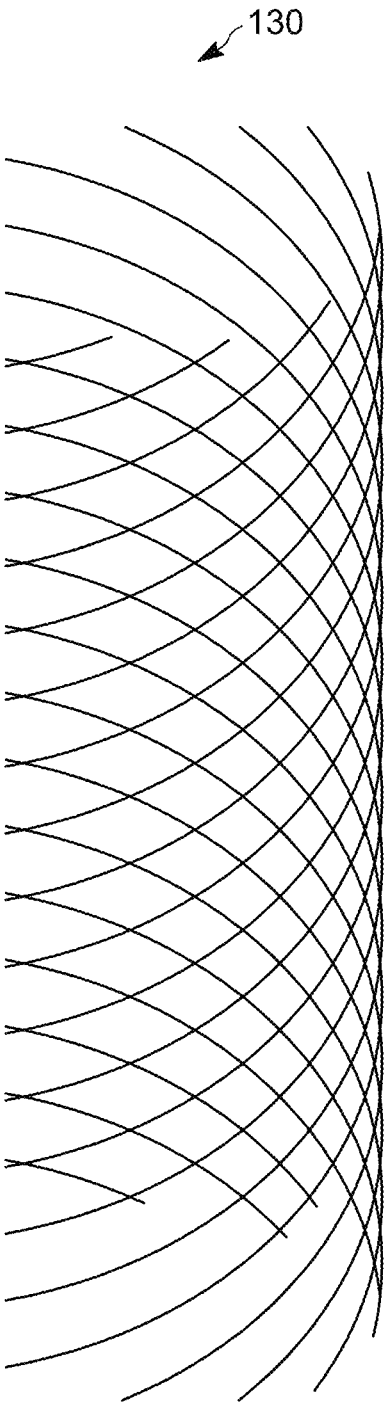
Figure 2:
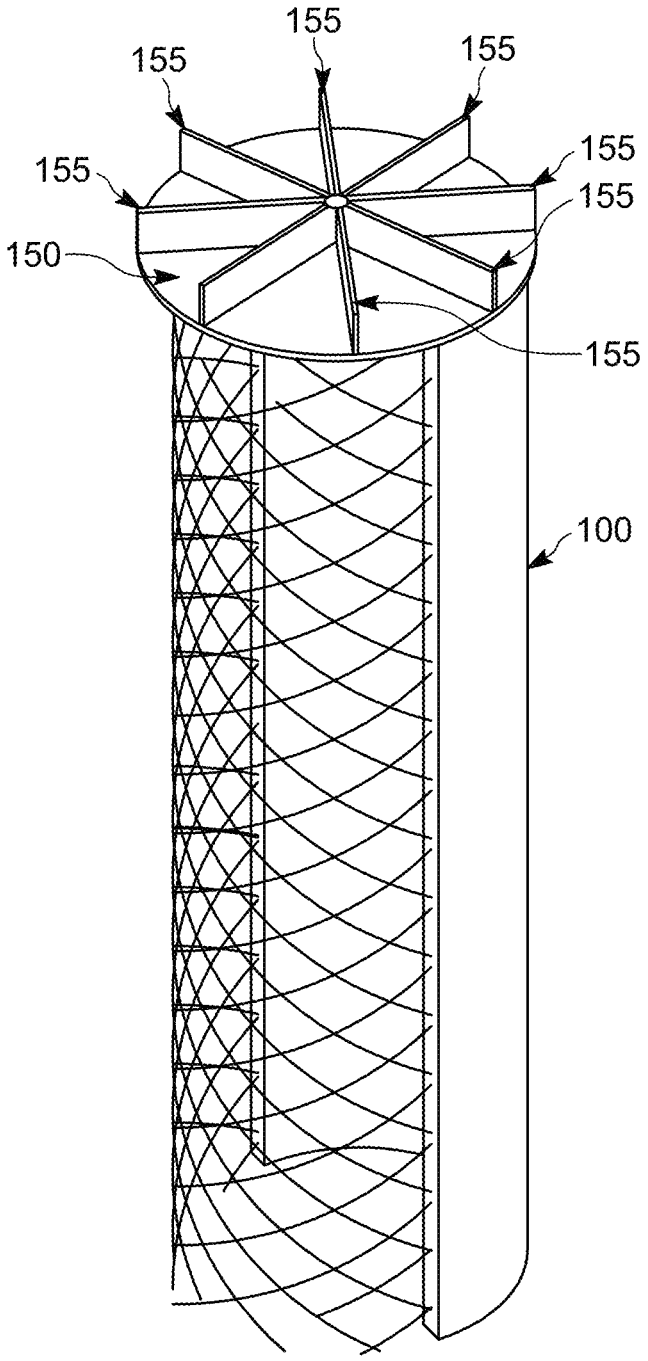
FIG. 2 shows a sectional perspective view along a plane parallel to and passing through the longitudinal axis of a second variant of the concrete suction anchor to which the padeye according to the invention is configured to be attached, wherein the whole post-tensioning tendons are visible.

FIG. 2 shows a second variant of the concrete suction anchor differing from the first variant shown in FIG. 1 in that it is devoid of any top dome 105. Differently, the top end of the cylindrical section 100 is closed by a top lid 150 provided with top stiffeners 155 evenly angularly distributed over the circular cross section of the cylindrical section 100.

Figure 3:
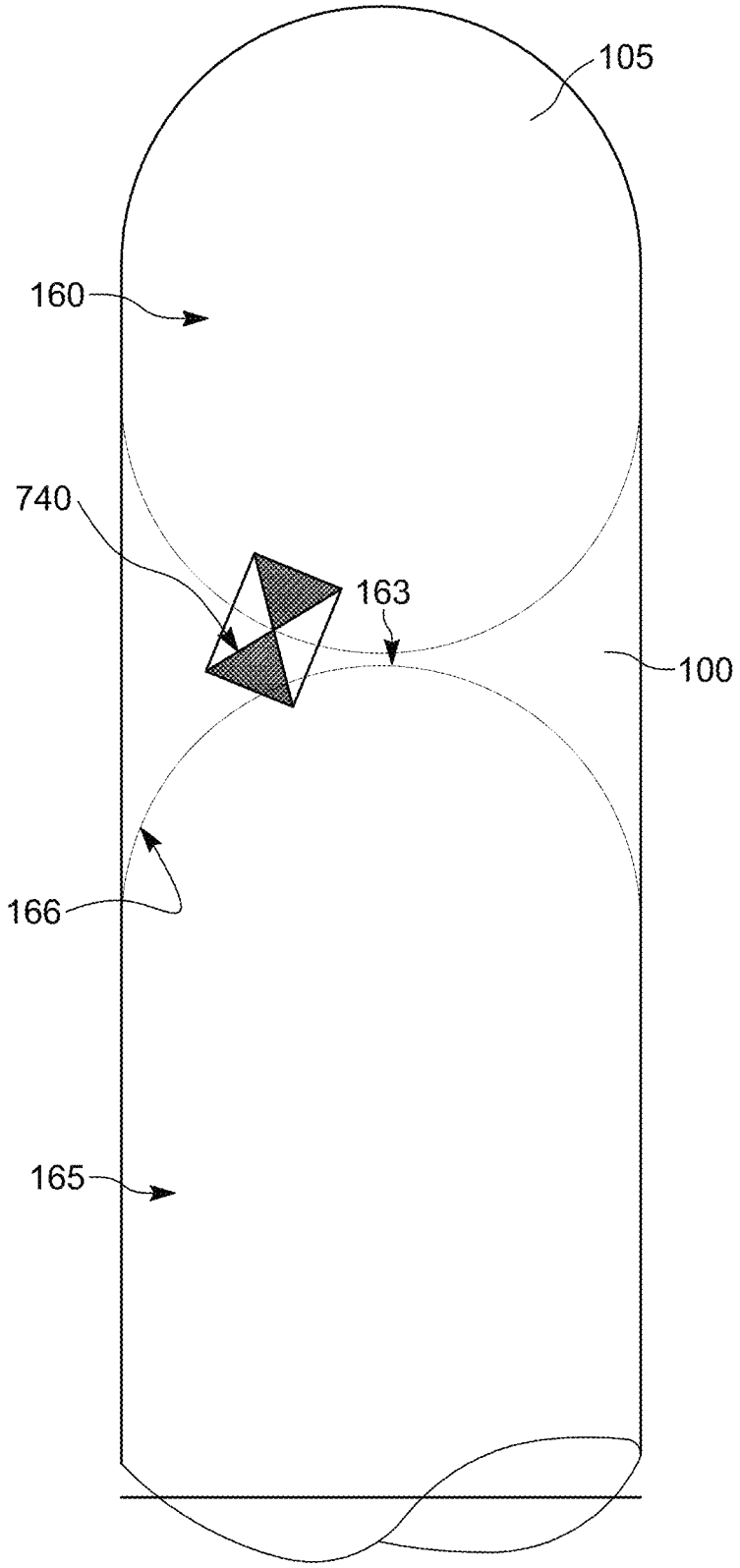
FIG. 3 shows a sectional view along a plane parallel to and passing through the longitudinal axis of a third variant of the concrete suction anchor to which the padeye according to the invention is configured to be attached.

FIG. 3 schematically shows a third variant of the concrete suction anchor differing from the first variant shown in FIG. 1 in that the top dome 105 defines an internal buoyancy chamber 160 having a substantially oval shape, the bottom surface 163 of which is concave, i.e. it has concavity directed towards the top surface of the oval-shaped internal buoyancy chamber 160, and in that the main cavity 165 of the cylindrical structure 100 has a top surface 166 that is a concave, i.e. it has concavity directed towards the open bottom end of the cylindrical structure 100.

FIG. 4 shows a fourth variant of the concrete suction anchor differing from the first variant shown in FIG. 1 in that the top dome 105 defines a top internal buoyancy chamber 170 having a bottom surface 172 that is convex, i.e. it has concavity directed towards the open bottom end of the cylindrical structure 100, and in that the cylindrical structure 100 has an intermediate internal buoyancy chamber 174 having a substantially oval shape and provided with stiffener 178 parallel to the longitudinal axis of the concrete suction anchor which are orthogonal to each other. The intermediate internal buoyancy chamber 174 is interposed between the top internal buoyancy chamber 170 and the main cavity 175 of the cylindrical structure 100, that has a top surface 176 that is a concave, i.e. it has concavity directed towards the open bottom end of the cylindrical structure 100.

FIG. 5 shows a top dome 205 of a fifth variant of the concrete suction anchor differing from the first variant shown in FIG. 1 in that the top dome 205 is provided with stiffener 208 parallel to the longitudinal axis of the concrete suction anchor which are evenly angularly distributed over the circular base of the top dome 205.

FIG. 6 shows a sixth variant of the concrete suction anchor differing from the forth variant shown in FIG. 4 in that the top dome 105 defines a top internal buoyancy chamber 180 having a substantially hemispherical shape with a substantially flat bottom surface 182, and in that the intermediate internal buoyancy chamber 184 has a substantially cylindrical shape and it is provided with thicker stiffener 188 parallel to the longitudinal axis of the concrete suction anchor which are still substantially orthogonal to each other. The top surface 186 of the main cavity 185 of the cylindrical structure 100 is also substantially flat.

It must be noted that other variants of the concrete suction anchor can be devoid of any internal buoyancy chamber, like in the second variant shown in FIG. 2, even in the case where the concrete suction anchor includes a top dome, still remaining within the scope of protection of the present invention.

As schematically shown in FIG. 7, and also with reference to FIG. 4, the variants of the concrete suction anchor including a top internal buoyancy chamber 700 have a first top valve 710, that is configured to put the top internal buoyancy chamber 700 in fluid communication with the external environment, a second top valve 720 that is configured to put the main cavity 730, acting as a suction chamber, of the cylindrical structure 100 in fluid communication with the external environment by means of a duct 725, and an internal vent 740 (not shown in FIG. 7, but schematically shown in FIGS. 3, 10*a*, 11 and 12) that puts the main cavity 730 of the cylindrical structure 100 in fluid communication with the top internal buoyancy chamber 700. The internal vent 740 can be a tunnel or built-in pipe. Advantageously, the first top valve 710 and the second top valve 720 can be controlled by a remotely operated vehicle (ROV) or otherwise remotely, and they might have connection to hoses all the way to the surface in case no ROV is used for controlling them.

Figure 4A:
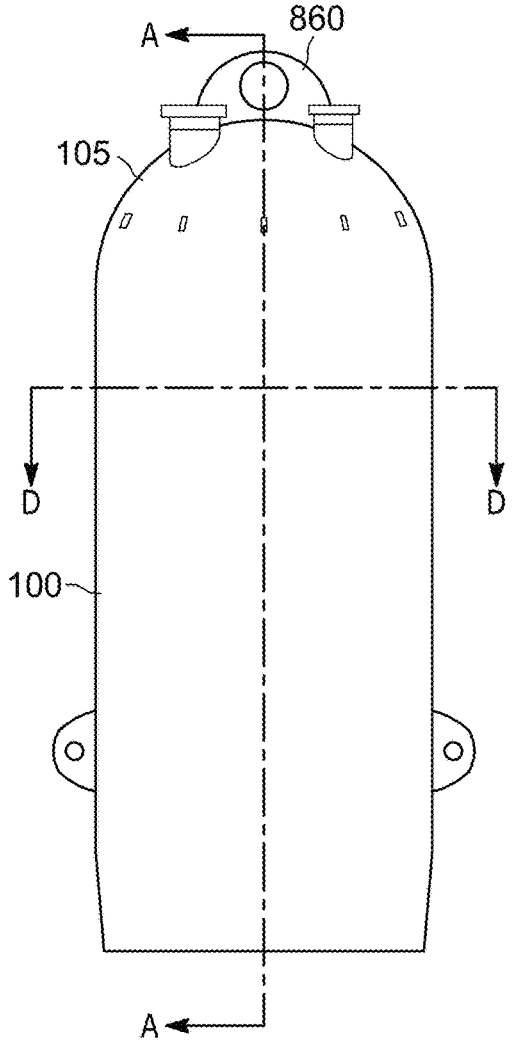
FIG. 4 shows a first side view (FIG. 4*a*), a top plan view (FIG. 4*b*), a side view partly in section according to plane AA of FIG. 4*a* (FIG. 4*c*), a sectional view according to plane EE of FIG. 4*b* (FIG. 4*d*), a second side view (FIG. 4*e*), and a sectional view according to plane EE of FIG. 4*a* (FIG. 4*f*)
Figure 4B:
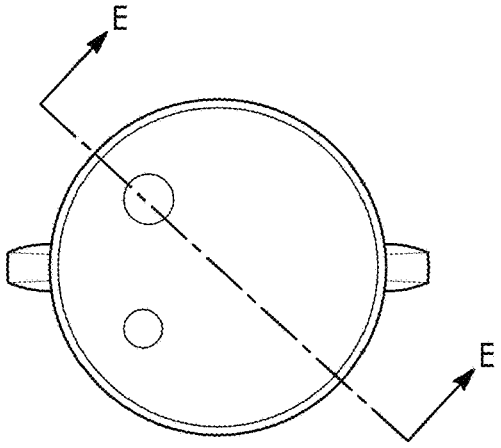
Figure 4C:
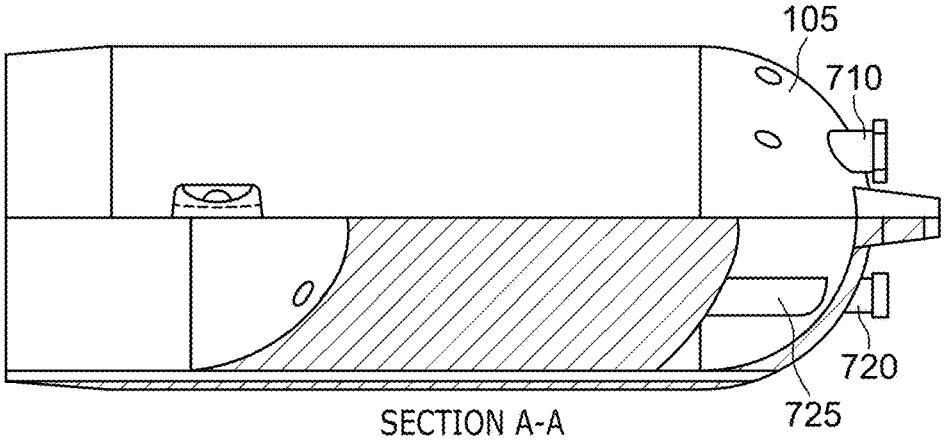
Figure 4D:
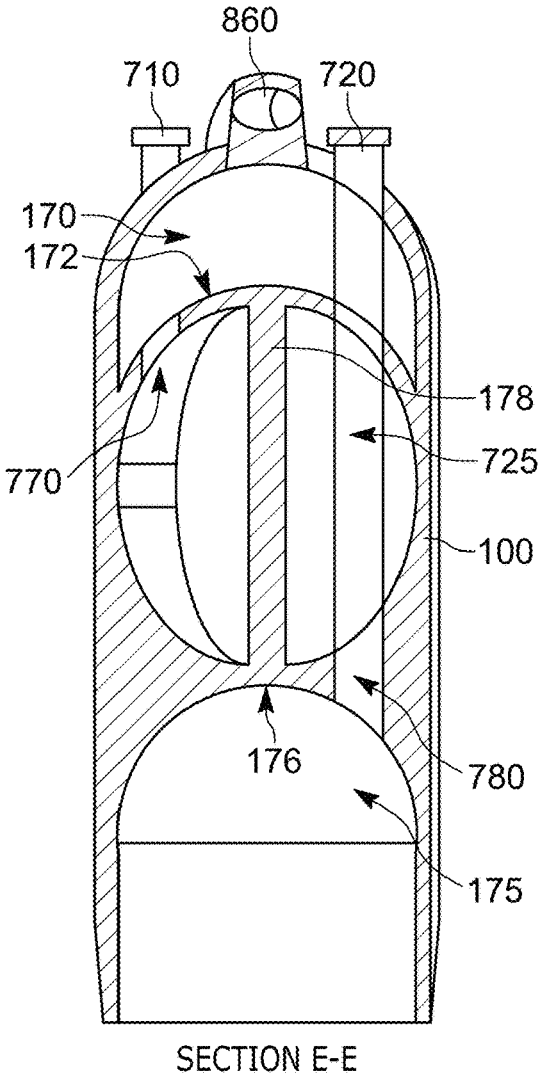
Figure 4E:
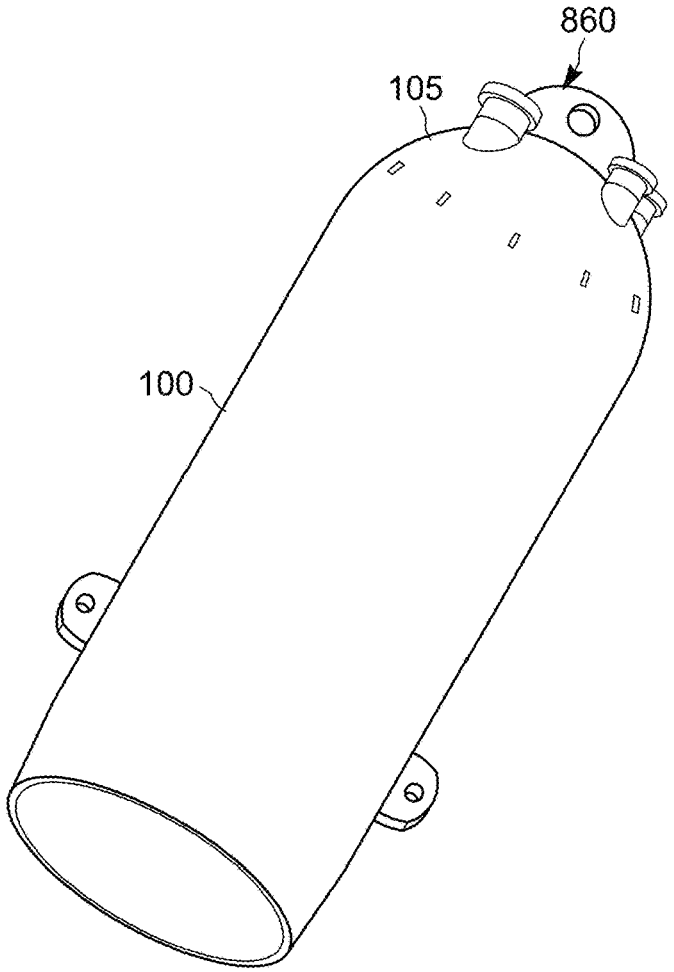
Figure 4F:
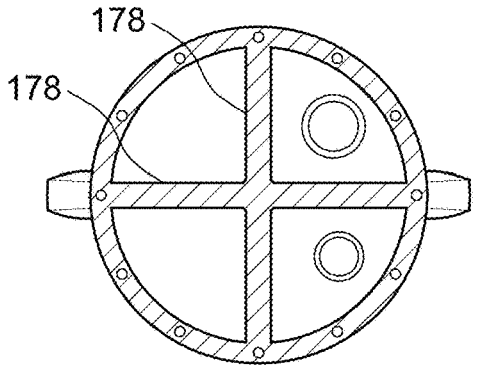
Figure 6D:
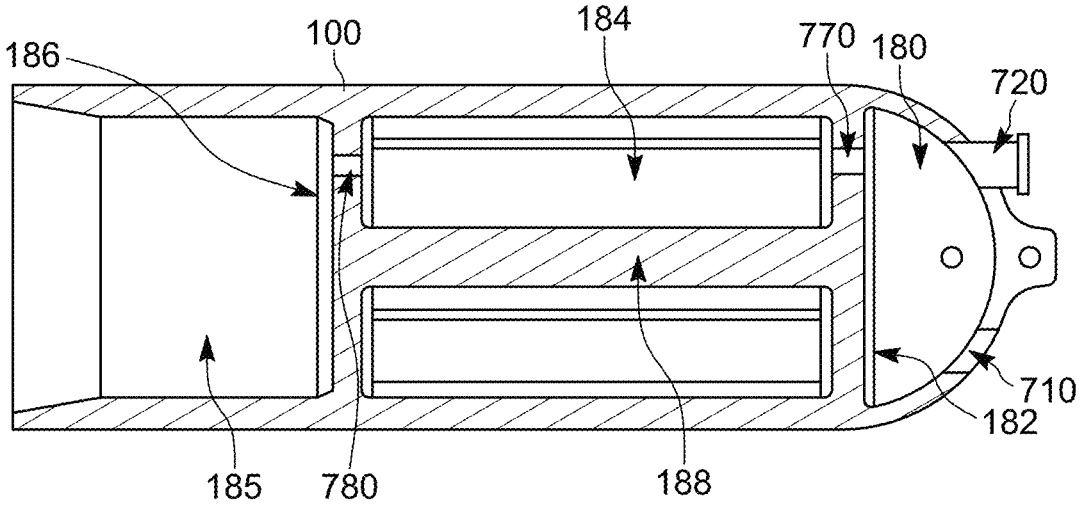
Figure 6E:
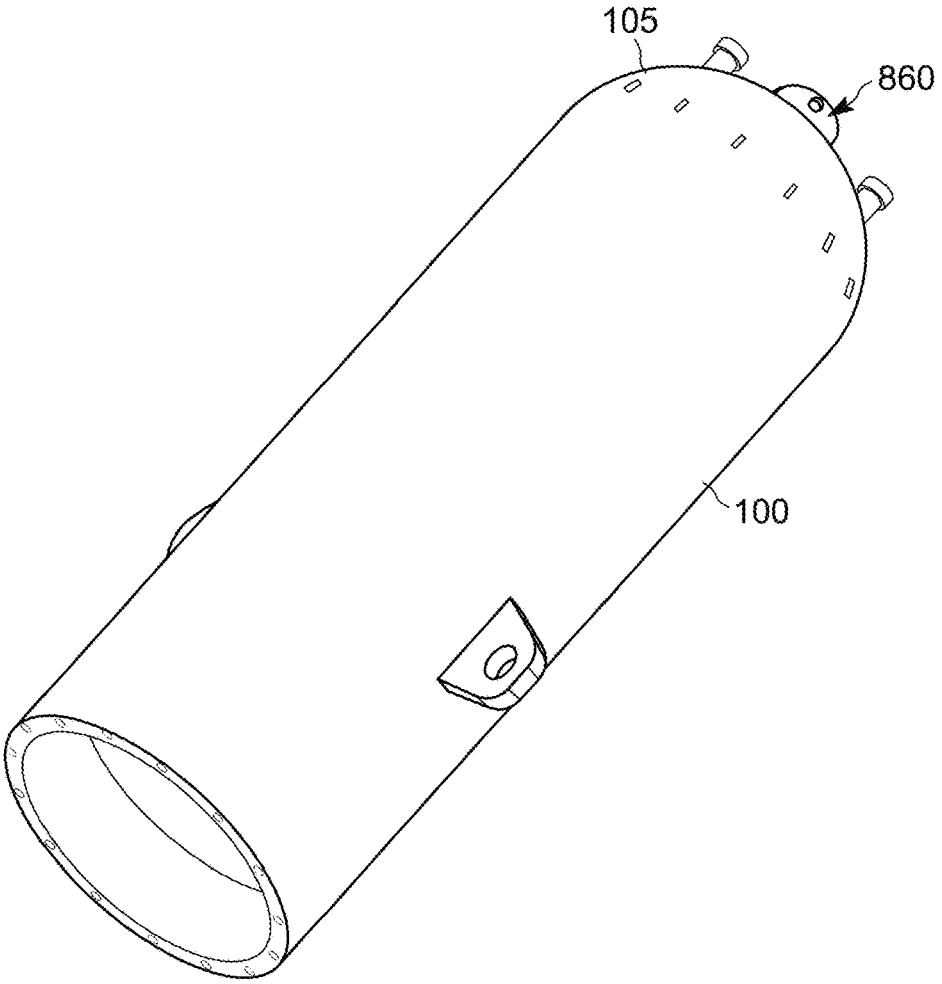
Figure 6F:
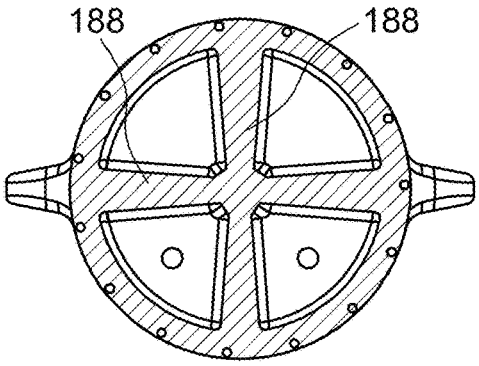
Figure 7D:
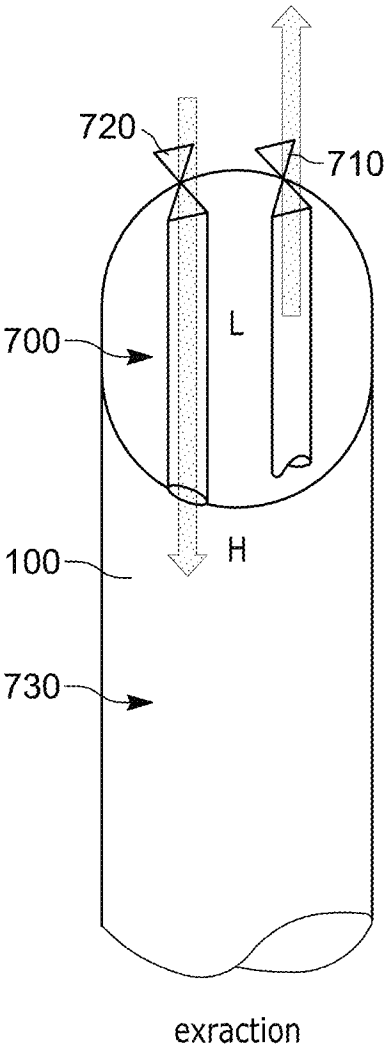
Figure 7C:
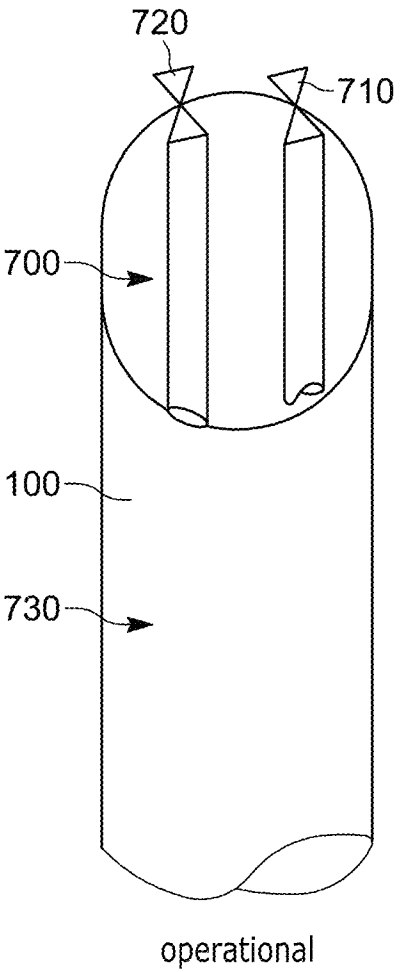
Figure 7B:
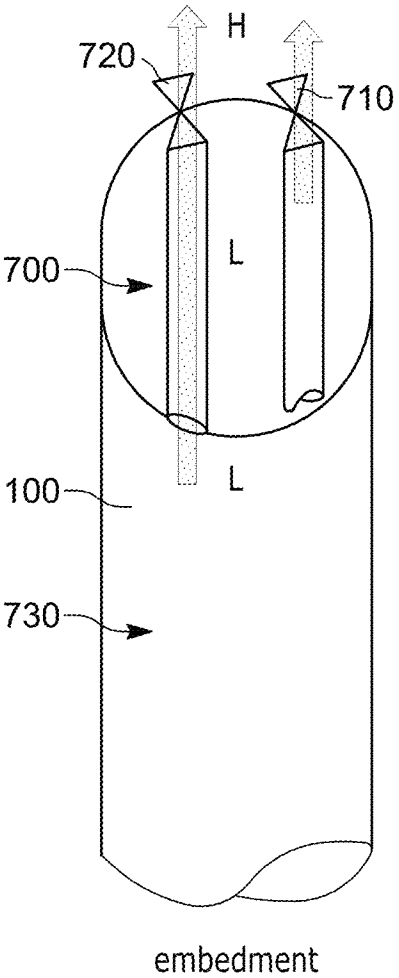
Figure 7A:
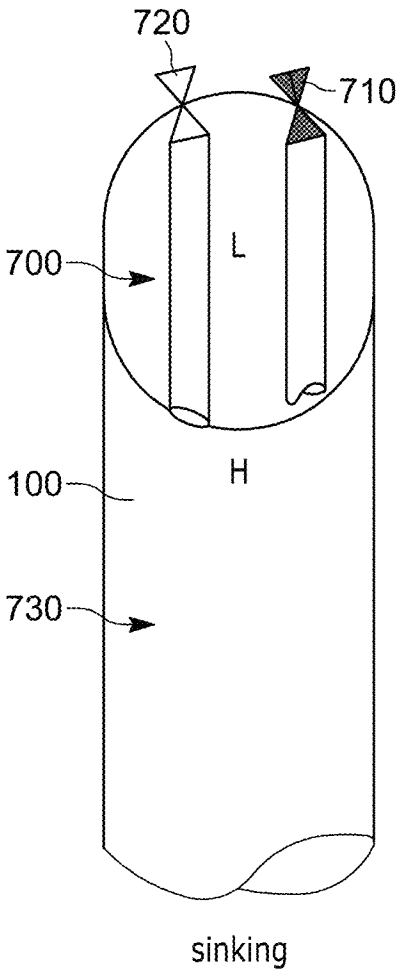
Figure 10B:
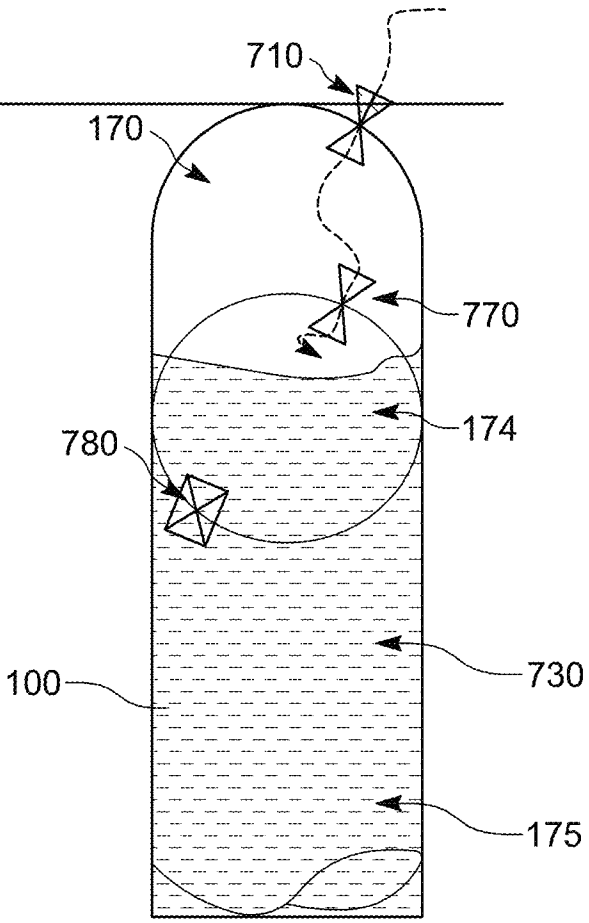
Figure 10A:
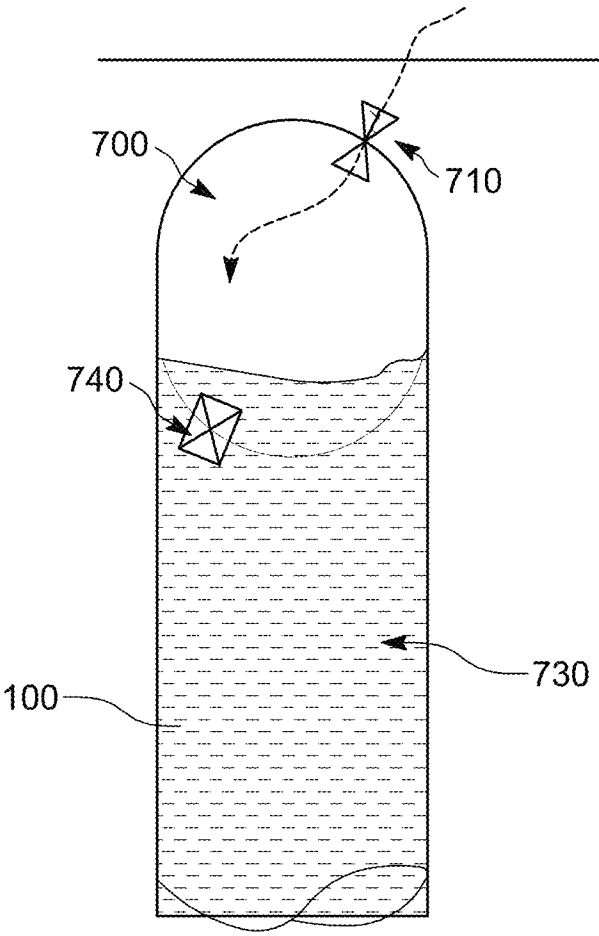

As shown in FIG. 7*a*, when the concrete suction anchor is in the sinking installation phase, the first top valve 710 is closed and the second top valve 720 is open thus putting the main cavity 730 of the cylindrical structure 100 in fluid communication with the external environment. As shown in FIG. 10*a*, such arrangement of the concrete suction anchor allows a better control of flooding by properly operating the first top valve 710 in order to adjust the amount of air inside the top internal buoyancy chamber 700, as well as possibly inside the main cavity 730 of the cylindrical structure 100, consequently adjusting the waterline. The same technical effects are achieved by other variants of the concrete suction anchor including more than one internal buoyancy chamber as shown in FIG. 10*b* for the fourth variant of the concrete suction anchor shown in FIG. 4, including a top internal buoyancy chamber 170 and an intermediate internal buoyancy chamber 174, wherein a top internal vent 770 puts the top internal buoyancy chamber 170 in fluid communication with the intermediate internal buoyancy chamber 174 and a bottom internal vent 780 puts the main cavity 175 of the cylindrical structure 100 in fluid communication with the intermediate internal buoyancy chamber 174; the top and bottom internal vents 770 and 780 are also shown in FIGS. 4*d* and 6*d*. Each of the top and bottom internal vents 770 and 780 can be a tunnel or built-in pipe.

Figure 11B:
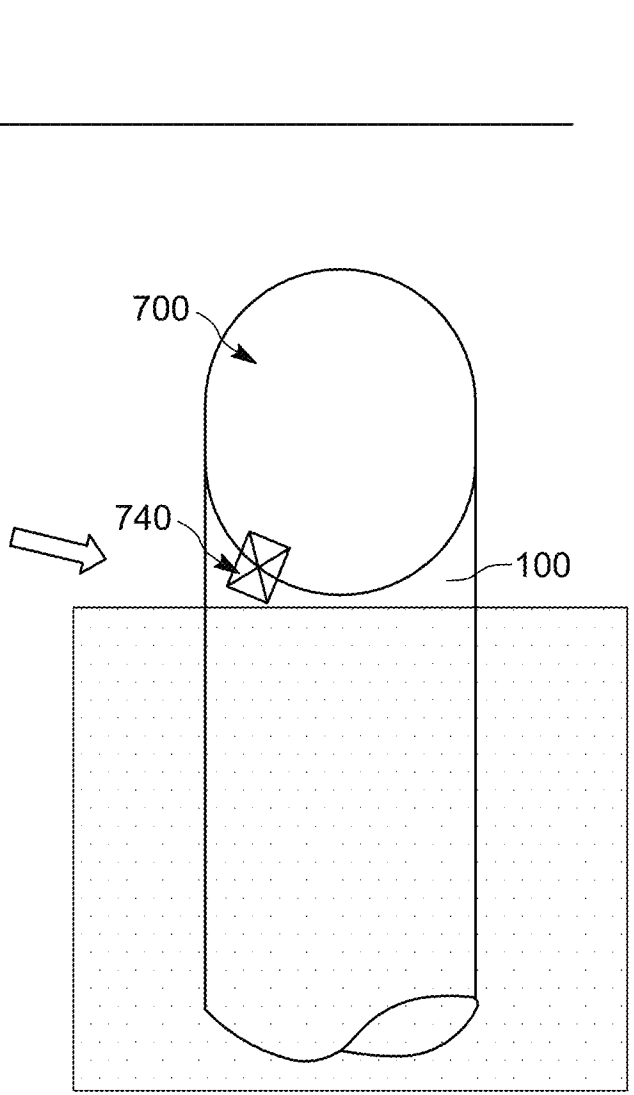
Figure 11A:
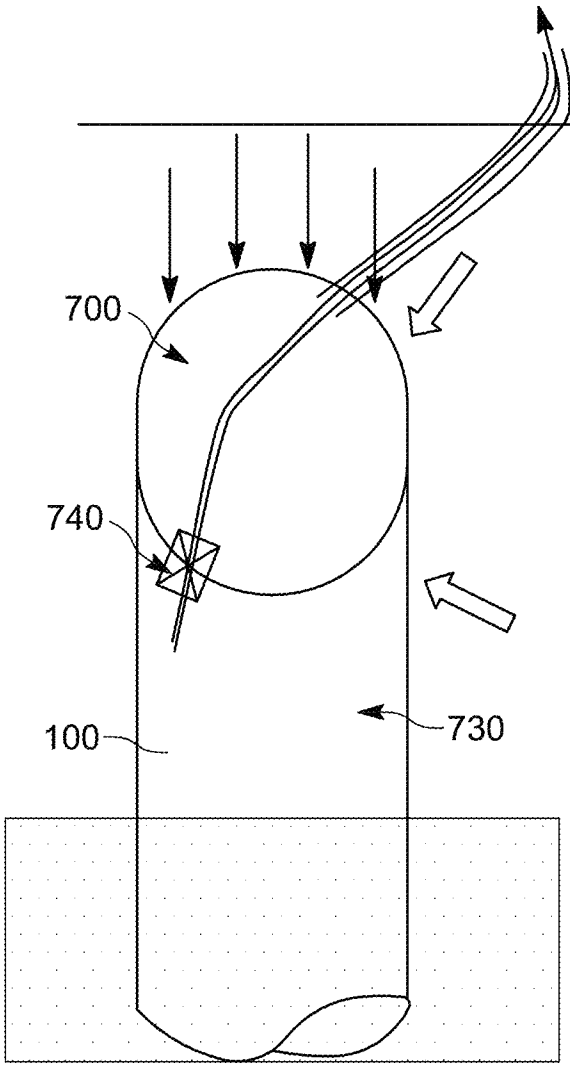

As shown in FIG. 7*b*, when the concrete suction anchor is in the operating condition of embedment, both the first top valve 710 and the second top valve 720 are open, thus putting both the top internal buoyancy chamber 700 and the main cavity 730 of the cylindrical structure 100 in fluid communication with the external environment; in the operating condition of embedment, at least one suction pump is connected to the first top valve 710 and second top valve 720 so as to suck water from the top internal buoyancy chamber 700 and the main cavity 730 of the cylindrical structure 100, creating a compression on the top dome causing the concrete suction anchor to penetrate the sea soil. This is also represented in FIG. 11, wherein the first and second top valves 710 are not shown, namely showing an intermediate position of the concrete suction anchor in FIG. 11*a* and a final embedded position of the concrete suction anchor in FIG. 11*b*.

As shown in FIG. 7*c*, when the concrete suction anchor is under usual operating condition, i.e. when the concrete suction anchor is embedded in the sea or lake soil, both the first top valve 710 and the second top valve 720 are open, thus putting both the top internal buoyancy chamber 700 and the main cavity 730 of the cylindrical structure 100 in fluid communication with the external environment.

Figure 12C:
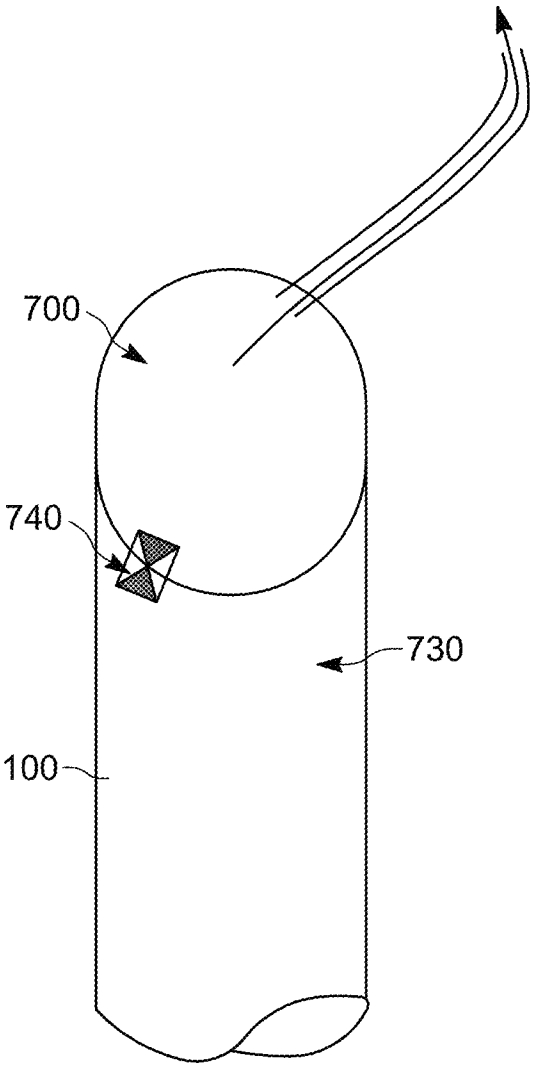
Figure 12B:
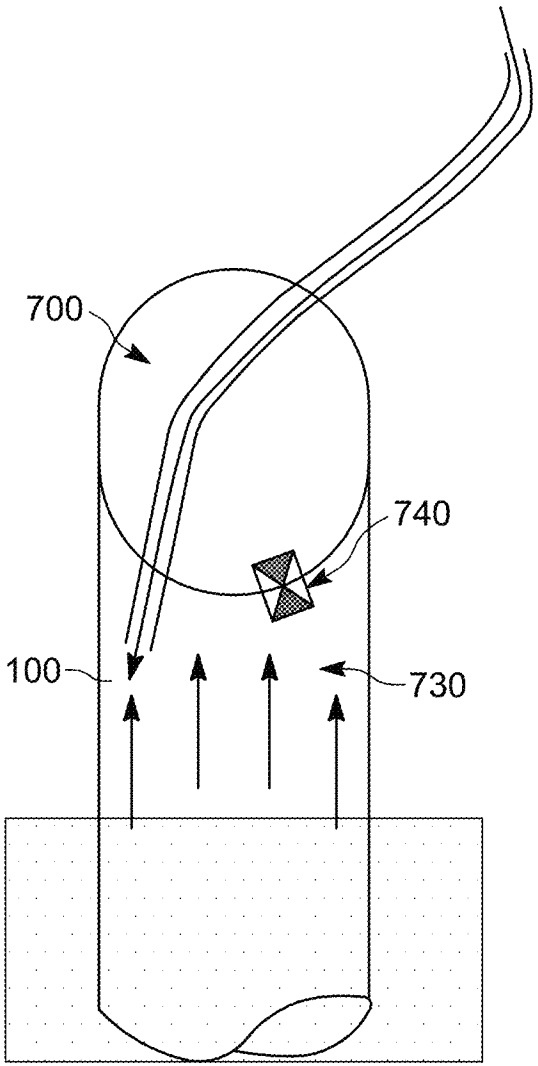
Figure 12A:
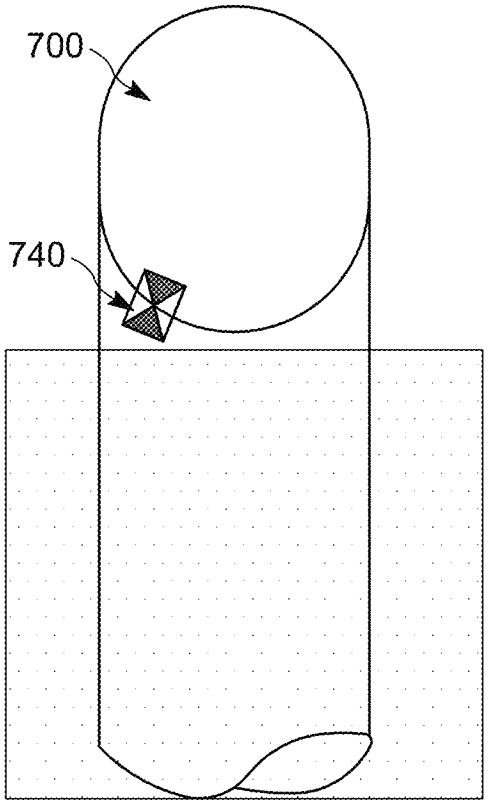

As shown in FIG. 7*d*, when the concrete suction anchor is in the operating condition of disembedment, both the first top valve 710 and the second top valve 720 are open, putting both the top internal buoyancy chamber 700 and the main cavity 730 of the cylindrical structure 100 in fluid communication with the external environment; in the operating condition of disembedment, a suction pump is connected to the first top valve 710 so as to suck water from the top internal buoyancy chamber 700, while an additional pump is connected to the second top valve 720 so as to force water into the main cavity 730 of the cylindrical structure 100. This creates a pressure on the bottom surface of the internal buoyancy chamber 700, the bottom surface causing the concrete suction anchor to be removed from the sea soil. This is also represented in FIG. 12, wherein the first and second top valves 710 are not shown, namely showing a starting embedded position of the concrete suction anchor in FIG. 12*a*, an intermediate position of the concrete suction anchor in FIG. 12*b* and a final disembedded position of the concrete suction anchor in FIG. 12*c*.

The variants of the concrete suction anchor including a top internal buoyancy chamber 700 can be effectively, easily and inexpensively transported via wet-towing techniques, as shown in FIGS. 8 ad 9 schematically representing the concrete suction anchor of FIG. 1: the three modes of transportation shown in FIG. 8 allow the concrete suction anchor to be transported with its longitudinal axis substantially parallel to the sea or lake surface, while the three modes of transportation shown in FIG. 8 allow the concrete suction anchor to be transported with its longitudinal axis substantially orthogonal to the sea or lake surface.

Figure 8B:
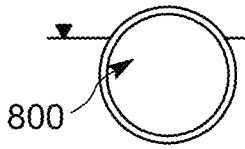
Figure 8A:
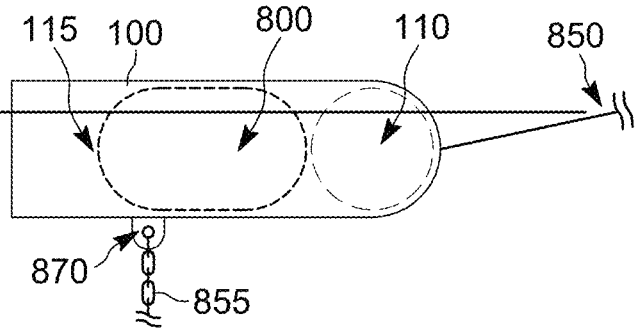

A first mode of transportation is shown in FIGS. 8*a*-8*b*, wherein a main elongated inflatable buoyancy unit 800 is placed inside the main cavity 115 of the cylindrical structure 100 of the concrete suction anchor and then inflated. A towing cable 850 attached to a top eye 860, shown in FIGS. 4 and 6, is configured to pull the concrete suction anchor. Also, a bottom chain 855 can be attached to at least one padeye 870 protruding from the lateral cylindrical wall of the cylindrical structure 100 of the concrete suction anchor.

Figure 8D:
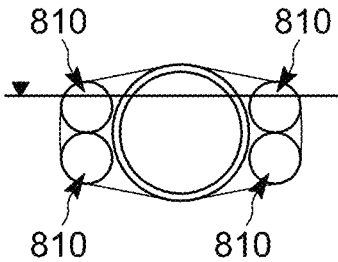
Figure 8C:
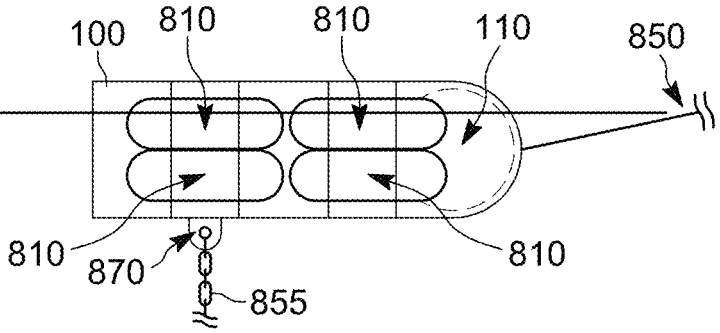

A second mode of transportation is shown in FIGS. 8*c*-8*d*, wherein a plurality of side inflatable buoyancy units 810 are attached around the cylindrical structure 100 of the concrete suction anchor; the side inflatable buoyancy units 810 can be inflated before being attached. Advantageously, the plurality of side inflatable buoyancy units 810 are subdivided in one or more pairs, wherein the two units 810 of each pair of units 810 are attached around the cylindrical structure 100 symmetrically with respect to a plane parallel to and passing through the longitudinal axis of the concrete suction anchor. In the example of FIGS. 8*c*-8*d*, there are eight side inflatable buoyancy units 810 and the two units 810 of each pair of units 810 are attached around the cylindrical structure 100 symmetrically with respect to the longitudinal axis of the concrete suction anchor and are aligned with another unit 810 along their own longitudinal axes. Similarly to FIGS. 8*a*-8*b*, a towing cable 850 is attached to the top eye 860 for pulling the concrete suction anchor and a bottom chain 855 can be attached to at least one padeye 870 protruding from the lateral cylindrical wall of the cylindrical structure 100 of the concrete suction anchor.

Figure 8F:
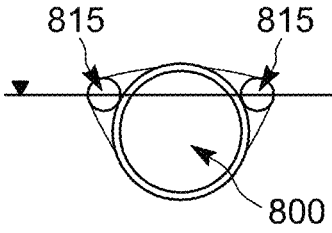
Figure 8E:
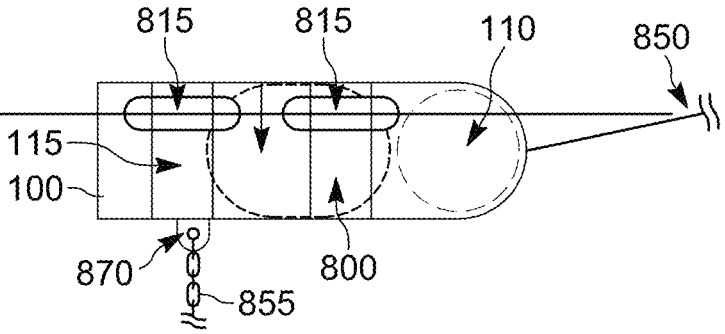

A third mode of transportation, shown in FIGS. 8*e*-8*f*, is a combination of the first and second modes. In fact, a main elongated inflatable buoyancy unit 800 is placed inside the main cavity 115 of the cylindrical structure 100 of the concrete suction anchor and then inflated, and a plurality of side inflatable buoyancy units 815 are attached around the cylindrical structure 100 of the concrete suction anchor; the side inflatable buoyancy units 815 can be inflated before being attached. Advantageously, the plurality of side inflatable buoyancy units 815 are subdivided in one or more pairs, wherein the two units 815 of each pair of units 815 are attached around the cylindrical structure 100 symmetrically with respect to a plane parallel to and passing through the longitudinal axis of the concrete suction anchor. In the example of FIGS. 8*e*-8*f*, there are four side inflatable buoyancy units 815 each of which is aligned with another unit 815 along their own longitudinal axes. Similarly to FIGS. 8*a*-8*b*, a towing cable 850 is attached to the top eye 860 for pulling the concrete suction anchor and a bottom chain 855 can be attached to at least one padeye 870 protruding from the lateral cylindrical wall of the cylindrical structure 100 of the concrete suction anchor.

FIG. 9 shows three additional modes of transportation with reference to a variant of the second variant shown in FIG. 2, wherein the top end of the cylindrical structure 100 of the concrete suction anchor is closed by a top lid 950, advantageously made of steel, instead of a top lid 150 provided with top stiffeners 155. Such variant and the variant of FIG. 2 are especially used as stout anchor for sandy soils, where it is not suggestable to add buoyancy chambers not to cause the concrete suction anchor to be too big.

Figure 9A:
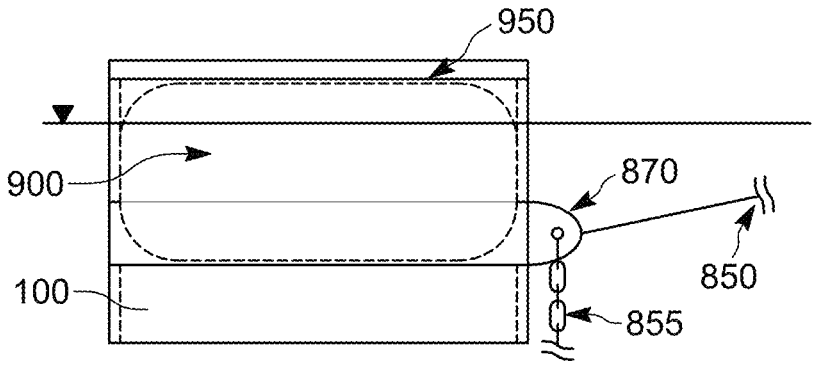

A fourth mode of transportation is shown in FIG. 9*a*, wherein a main inflatable buoyancy unit 900 is placed inside the main cavity 115 of the cylindrical structure 100 of the concrete suction anchor and then inflated; when inflated, the main inflatable buoyancy unit 900 occupies the top part of the main cavity 115 and is kept therein by the top lid 950. A towing cable 850 is attached to at least one padeye 870 protruding from the lateral cylindrical wall of the cylindrical structure 100 of the concrete suction anchor in correspondence of the top part of the main cavity 115, so as to be configured to pull the concrete suction anchor. Also, a bottom chain 855 can be attached to at least one padeye 870, possibly the same padeye 870 to which the towing cable 850 is attached as shown in FIG. 9*a*.

Figure 9B:
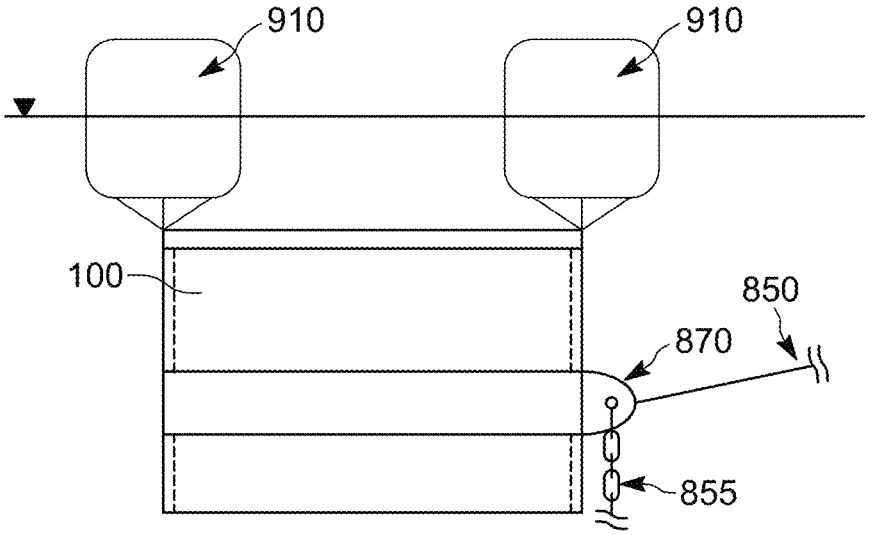
Figure 9C:
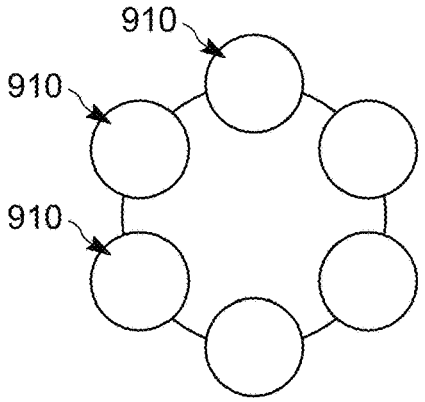

A fifth mode of transportation is shown in FIGS. 9*b*-9*c*, wherein a plurality of top inflatable buoyancy units 910 are attached around the circular edge of the top lid 950 of the concrete suction anchor; the top inflatable buoyancy units 910 can be inflated before being attached. Advantageously, the plurality of top inflatable buoyancy units 910 are evenly angularly distributed over the circumference of the circular edge of the top lid 950. In the example of FIGS. 9*b*-9*c*, there are six top inflatable buoyancy units 910. Similarly to FIG. 9*a*, a towing cable 850 is attached to at least one padeye 870 protruding from the lateral cylindrical wall of the cylindrical structure 100 of the concrete suction anchor for pulling the concrete suction anchor and a bottom chain 855 can be attached to at least one padeye 870.

Figure 9D:
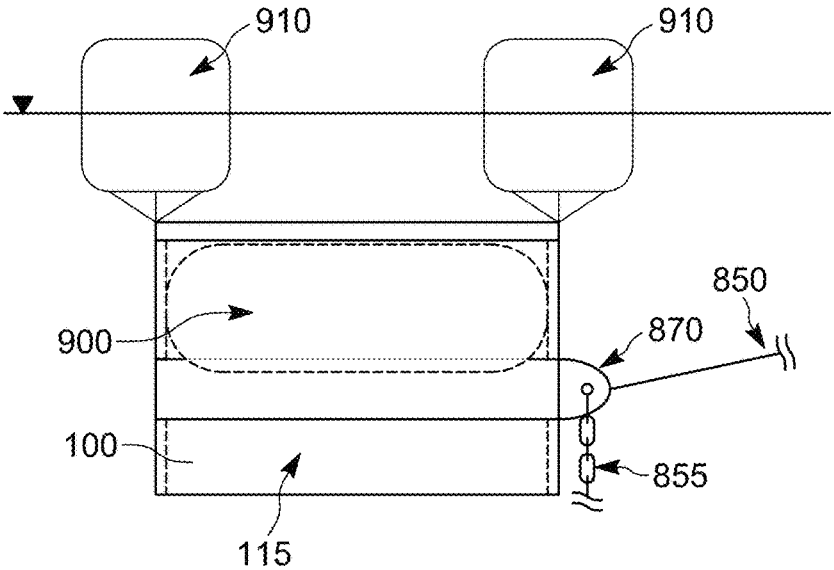
Figure 9E:
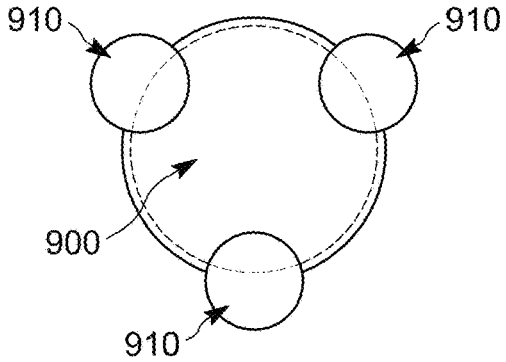

A sixth mode of transportation, shown in FIGS. 9*d*-9*e*, is a combination of the fourth and fifth modes. In fact, a main inflatable buoyancy unit 900 is placed inside the main cavity 115 of the cylindrical structure 100 of the concrete suction anchor and then inflated, and a plurality of top inflatable buoyancy units 910 are attached around the circular bottom edge of the cylindrical structure 100 of the concrete suction anchor. When inflated, the main inflatable buoyancy unit 900 occupies the top part of the main cavity 115 and is kept therein by the top lid 950. The top inflatable buoyancy units 910 can be inflated before being attached. Advantageously, the plurality of top inflatable buoyancy units 910 are evenly angularly distributed over the circumference of the circular edge of the top lid 950. In the example of FIGS. 9*d*-9*e*, there are three top inflatable buoyancy units 910. Similarly to FIG. 9*a*, a towing cable 850 is attached to at least one padeye 870 protruding from the lateral cylindrical wall of the cylindrical structure 100 of the concrete suction anchor for pulling the concrete suction anchor and a bottom chain 855 can be attached to at least one padeye 870.

Similar modes of transportation using one or more inflatable buoyancy units are applicable also to other variants of the concrete suction anchor which are devoid of any top internal buoyancy chamber, such as the variant shown in FIG. 2.

As shown in FIGS. 13, direct connection of mooring lines, cables and chains to a padeye protruding from the lateral cylindrical wall of the cylindrical structure of the concrete suction anchor can create an important butterfly effect, that is a localized stress concentration in terms of shear and stress due to out of plane bending in the areas close to the padeye location. The padeye can be located at 30% of the length of the lateral cylindrical wall of the cylindrical structure of the concrete suction starting from the bottom of the cylindrical structure.

Making reference to FIGS. 14-16, the seventh variant of the concrete suction anchor includes the first embodiment of the padeye according to the invention, referred to with numeral 1000, wherein the padeye 1000 protrudes from a supporting plate 1100 that is incorporated into the lateral cylindrical wall of the cylindrical structure 100 of the concrete suction anchor; to this end, the lateral cylindrical wall of the cylindrical structure 100 of the concrete suction anchor has an aperture corresponding to the supporting plate 1100; the supporting plate 1100 advantageously has a shape substantially matching the lateral cylindrical wall of the cylindrical structure 100. The padeye 1000 and the supporting plate 1100 are advantageously made of steel.

The supporting plate 1100 is provided with longitudinal stiffeners 1150, which are substantially orthogonal to the supporting plate 1100 and parallel to the longitudinal axis of the cylindrical structure 100 when the supporting plate 1100 is incorporated into the lateral cylindrical wall of the cylindrical structure 100, and with transversal stiffeners 1170, which are substantially orthogonal to the supporting plate 1100 and to the longitudinal axis of the cylindrical structure 100 when the supporting plate 1100 is incorporated into the lateral cylindrical wall of the cylindrical structure 100. The supporting plate 1100 includes a plurality of internal plate channels housing sections of the post-tensioning tendons 125 and 130 of the pair of sets of post-tensioning tendons housed in the plurality of internal channels of the lateral cylindrical wall of the cylindrical structure 100 of the concrete suction anchor, as illustrated above with reference to FIG. 1. Advantageously, to allow an adjustment of the position of the supporting plate 1100 into the corresponding aperture of the lateral cylindrical wall of the cylindrical structure 100, so as to align the plurality of internal plate channels of the former with the plurality of internal channels of the lateral cylindrical wall of the cylindrical structure 100, the area of the supporting plate 1100 is slightly lower than that of the corresponding aperture and structural filling mortar is interposed between the lateral edges of the supporting plate 1100 and the edges of the corresponding aperture.

Making reference to FIGS. 17-18, the eighth variant of the concrete suction anchor includes a second embodiment of the padeye according to the invention, referred to with numeral 2000, wherein the padeye 2000 protrudes from a supporting plate 2100 that is configured to be attached to the lateral cylindrical wall of the cylindrical structure 100 of the concrete suction anchor by means of attachment tendons 2200. The attachment tendons 2200 are configured to pass through respective anchorage passages inside the lateral cylindrical wall of the cylindrical structure 100 of the concrete suction anchor; each of such anchorage passages is advantageously arranged along a respective circumference orthogonal to the longitudinal axis of the cylindrical structure 100 of the concrete suction anchor, even if this is not an essential feature of the invention and each of the anchorage passages can also move along a section of the length of the cylindrical structure 100 of the concrete suction anchor. Once introduced into said respective anchorage passages, the ends of the attachment tendons 2200 are fixed to the supporting plate 2100 by any conventional device. Advantageously, the ends of each attachment tendon 2200 is secured by conventional anchorage wedges 2300 placed at the supporting plate 2100; a post-tensioning can be applied to the attachment tendons 2200 by the anchorage wedges 2300. The supporting plate 2100 advantageously has a shape substantially matching the lateral cylindrical wall of the cylindrical structure 100. The padeye 2000 and the supporting plate 2100 are advantageously made of steel.

Making reference to FIGS. 19-20, the ninth variant of the concrete suction anchor includes a third embodiment of the padeye according to the invention, referred to with numeral 3000, wherein the padeye 3000 is integrally coupled to two side half collars 3100 having a cylindrical band shape. The two side half collars 3100 are each provided, at their diametrical ends with respect to the padeye 3000, with a respective flange 3200. By attaching the flanges 3200 to each other, the two side half collars 3100 are configured to be attached, possibly in a removable manner, to the lateral cylindrical wall of the cylindrical structure 100 of the concrete suction anchor. Also, the two side half collars 3100 can be attached, possibly in a removable manner, to the lateral cylindrical wall of the cylindrical structure 100 of the concrete suction anchor by means of a plurality of fasteners 3300. The padeye 3000 and the two side half collars 3100, along with the flanges 3200, are advantageously made of steel.

It must be noted that the side half collars can have a shape different from a cylindrical band shape, for instance a prismatic shape, optionally a prismatic band shape, and that each side half collar can be replaced with one or more circular rods.

FIG. 21 shows a tenth variant of the concrete suction anchor to which the third embodiment of the padeye according to the invention as shown in FIGS. 19-20 is attached, wherein the concrete suction anchor differs from the first variant shown in FIG. 1 in that it includes two closable side vents 790 configured to put the main cavity 115 of the cylindrical structure 100 of the concrete suction anchor in fluid communication with the external environment.

The padeye according to the invention acts as an eyelet where the mooring line connects to the anchor. The padeye embodiments disclosed herein are well suited for use with concrete any suction anchors, and in particular with any concrete suction anchors, by providing connection mechanisms or modalities that engage the concrete in a manner that is easy and inexpensive to manufacture, transport, install, maintain and replace.

While the above provides a full and compete illustration of exemplary embodiments of the present invention, various modifications, alternate constructions and equivalents may be employed as desired. Consequently, although the embodiments have been described in some detail, by way of example and for clarity of understanding, a variety of modification, changes, and adaptions will be obvious to those of skill in the art. Accordingly, the above description and illustrations should not be construed as limiting the scope of protection thereof, as defined by the attached claims.

The invention claimed is:

1. An anchor system comprising:

a suction anchor including a cylindrical structure that has a lateral cylindrical wall and a longitudinal axis, wherein the lateral cylindrical wall has a cylindrical shape; and a padeye, wherein the padeye is connected to attachment elements that are attached to said lateral cylindrical wall of the suction anchor;

said attachment elements include a supporting plate from which the padeye protrudes, wherein the supporting plate is configured to be incorporated into said lateral cylindrical wall of the suction anchor, and wherein the supporting plate has a cylindrical shape that substantially matches the cylindrical shape of the lateral cylindrical wall of the suction anchor.

2. The anchor system according to claim 1, wherein:

wherein the supporting plate is located in a corresponding aperture of said lateral cylindrical wall; and the supporting plate includes a plurality of internal plate channels that house sections of at least part of post-tensioning tendons of at least one pair of sets of post-tensioning tendons housed in a plurality of internal channels included in said lateral cylindrical wall of the suction anchor.

3. The anchor system according to claim 2, wherein the supporting plate is provided with longitudinal stiffeners, which are substantially orthogonal to the supporting plate and configured to be parallel to said longitudinal axis.

4. The anchor system according to claim 2, wherein the supporting plate is provided with transversal stiffeners, which are substantially orthogonal to the supporting plate and configured to be orthogonal to said longitudinal axis.

5. The anchor system according to claim 2, wherein the padeye and the supporting plate are made of steel.

6. The anchor system according to claim 3, wherein the supporting plate is provided with transversal stiffeners, which are substantially orthogonal to the supporting plate and configured to be orthogonal to said longitudinal axis when the supporting plate is incorporated into said lateral cylindrical wall.

7. The anchor system according to claim 1, wherein:

the supporting plate includes a plurality of internal plate channels configured to house sections of at least part of post-tensioning tendons of at least one pair of sets of post-tensioning tendons housed in a plurality of internal channels included in said lateral cylindrical wall of the suction anchor.

8. The anchor system according to claim 1, wherein:

the suction anchor includes at least one set of post-tensioning tendons in the lateral cylindrical wall; and the supporting plate includes a plurality of internal plate channels that house sections of at least part of the post-tensioning tendons of the at least one set of post-tensioning tendons.

9. The anchor system according to claim 8, wherein the supporting plate is provided with longitudinal stiffeners that protrude from a side of the supporting plate that is opposite the padeye, which are substantially orthogonal to the supporting plate and are parallel to said longitudinal axis of the cylindrical structure.

10. The anchor system according to claim 9, wherein the supporting plate is provided with transversal stiffeners that protrude from the side of the supporting plate that is opposite the padeye, which are substantially orthogonal to the supporting plate and orthogonal to said longitudinal axis of the cylindrical structure.

11. The anchor system according to claim 1, wherein the supporting plate is provided with longitudinal stiffeners that protrude from a side of the supporting plate that is opposite the padeye, which are substantially orthogonal to the supporting plate and parallel to the longitudinal axis of the cylindrical structure.

12. The anchor system according to claim 11, wherein the supporting plate is provided with transversal stiffeners that protrude from the side of the supporting plate that is opposite the padeye, which are substantially orthogonal to the supporting plate and orthogonal to said longitudinal axis.

13. The anchor system according to claim 12, wherein:

the suction anchor includes at least one set of post-tensioning tendons in the lateral cylindrical wall; and the supporting plate includes a plurality of internal plate channels that house sections of at least part of the post-tensioning tendons of the at least one set of post-tensioning tendons.

* * * * *